US011672355B2

(12) United States Patent
Sasaki

(10) Patent No.: US 11,672,355 B2
(45) Date of Patent: Jun. 13, 2023

(54) STRUCTURE

(71) Applicant: PARAMOUNT BED CO., LTD., Tokyo (JP)

(72) Inventor: Yusuke Sasaki, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 107 days.

(21) Appl. No.: 17/260,962

(22) PCT Filed: Jul. 30, 2019

(86) PCT No.: PCT/JP2019/029759
§ 371 (c)(1),
(2) Date: Jan. 15, 2021

(87) PCT Pub. No.: WO2020/174716
PCT Pub. Date: Sep. 3, 2020

(65) Prior Publication Data

US 2021/0321787 A1 Oct. 21, 2021

(30) Foreign Application Priority Data

Feb. 27, 2019 (JP) ..... JP2019-035001

(51) Int. Cl.
*A47C 21/08* (2006.01)
*A61G 7/05* (2006.01)
(Continued)

(52) U.S. Cl.
CPC ..... *A47C 21/08* (2013.01); *A61G 7/015* (2013.01); *A61G 7/052* (2016.11); *A61G 7/053* (2013.01)

(58) Field of Classification Search
CPC ..... A47C 21/08; A61G 7/053; A61G 7/051; A61G 7/0518
See application file for complete search history.

(56) References Cited

U.S. PATENT DOCUMENTS 4,932,090 A * 6/1990 Johansson ..... A61G 7/053 5/662
6,240,583 B1 * 6/2001 Brooke ..... A61G 7/0522 5/430
2019/0374418 A1 * 12/2019 Lam ..... A61G 7/0512

FOREIGN PATENT DOCUMENTS

JP S5445591 U 3/1979
JP H0411026 U 1/1992
(Continued)

OTHER PUBLICATIONS

International Search Report dated Oct. 8, 2019, mailed in counterpart International Application No. PCT/JP2019/029759, 9 pages.

*Primary Examiner* — Robert G Santos
*Assistant Examiner* — Adam C Ortiz
(74) *Attorney, Agent, or Firm* — Kim & Stewart LLP

(57) ABSTRACT

According to an embodiment, a structure is detachably attached to a bed apparatus. The bed apparatus includes a holder and a first frame that includes a portion extending in a first direction. The structure includes: a first portion of a columnar shape extending in a second direction that intersects the first direction; and a second portion continuous to the first portion and including a portion extending in a third direction that intersects the second direction. The first portion is inserted in the holder so that the holder holds the structure. When the structure is attached to the bed apparatus, an angle between the first direction and the third direction is variable. The structure that can facilitate aid of bed departure can be provided.

10 Claims, 25 Drawing Sheets

(51) Int. Cl.
*A61G 7/015* (2006.01)
*A61G 7/053* (2006.01)

(56) References Cited

FOREIGN PATENT DOCUMENTS

| | | | |
|---|---|---|---|
| JP | 2000229020 | A | 8/2000 |
| JP | 2003033256 | A | 2/2003 |
| JP | 2015202378 | A | 11/2015 |
| JP | 2017225762 | A | 12/2017 |
| WO | 2020174716 | A1 | 9/2020 |

* cited by examiner (a)

(b)

(a)

(b)

(c)

(a)

(b)

STRUCTURE

TECHNICAL FIELD

An embodiment of the present invention relates to a structure.

BACKGROUND ART

For example, there is a demand for preventing a user of a bed from falling from the bed. Moreover, there is a demand for aiding bed departure to encourage the user to depart from the bed.

RELATED ART DOCUMENTS

Patent Documents

Patent Document 1: Japanese Unexamined Patent Application Publication No. 2017-225762.

DISCLOSURE OF THE INVENTION

Problems to be Solved by the Invention

The embodiment of the invention provides a structure that can facilitate aid of bed departure.

Means for Solving the Problems

According to the embodiment of the invention, a structure is configured to be detachably attached to a bed apparatus. The bed apparatus includes a holder and a first frame that includes a portion extending in a first direction. The structure includes: a first portion of a columnar shape extending in a second direction that intersects the first direction; and a second portion continuous to the first portion and including a portion extending in a third direction that intersects the second direction. The first portion is inserted in the holder so that the holder is configured to hold the structure. When the structure is attached to the bed apparatus, an angle between the first direction and the third direction is variable.

Effects of the Invention

According to the embodiment of the invention, it is possible to provide the structure that can facilitate aid of bed departure.

MODE FOR CARRYING OUT THE INVENTION

Figure 1:
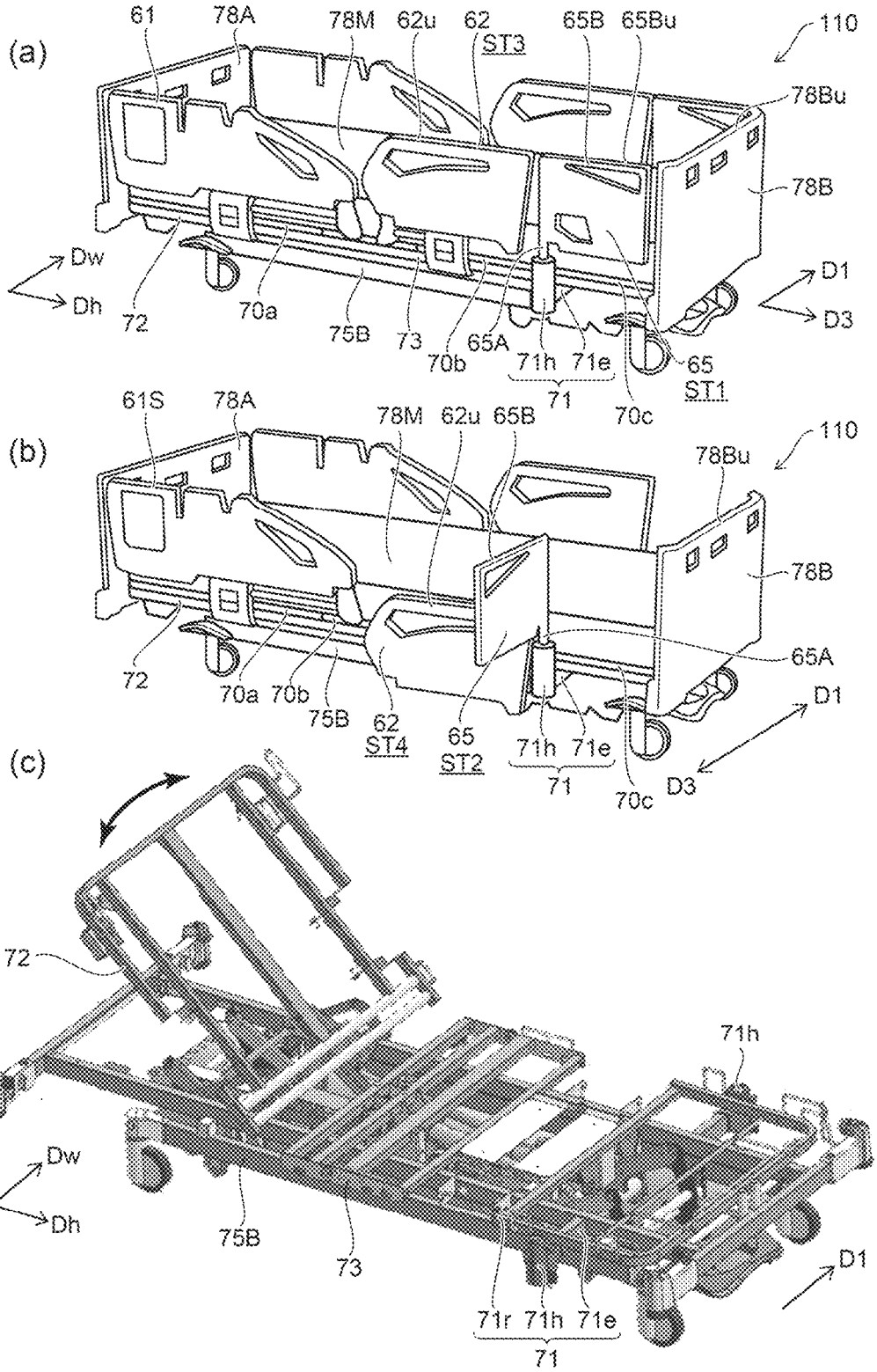
FIG. 1(*a*) to FIG. 1(*c*) are schematic perspective views illustrating a bed apparatus according to an embodiment.

Hereinafter, each embodiment of the invention will be described with reference to the drawings.

In the description of this application and each of the drawings, substantially the same elements as those already described with reference to a preceding drawing are denoted by identical reference numerals and signs and will not be elaborated as appropriate.

Embodiment

Figure 2:
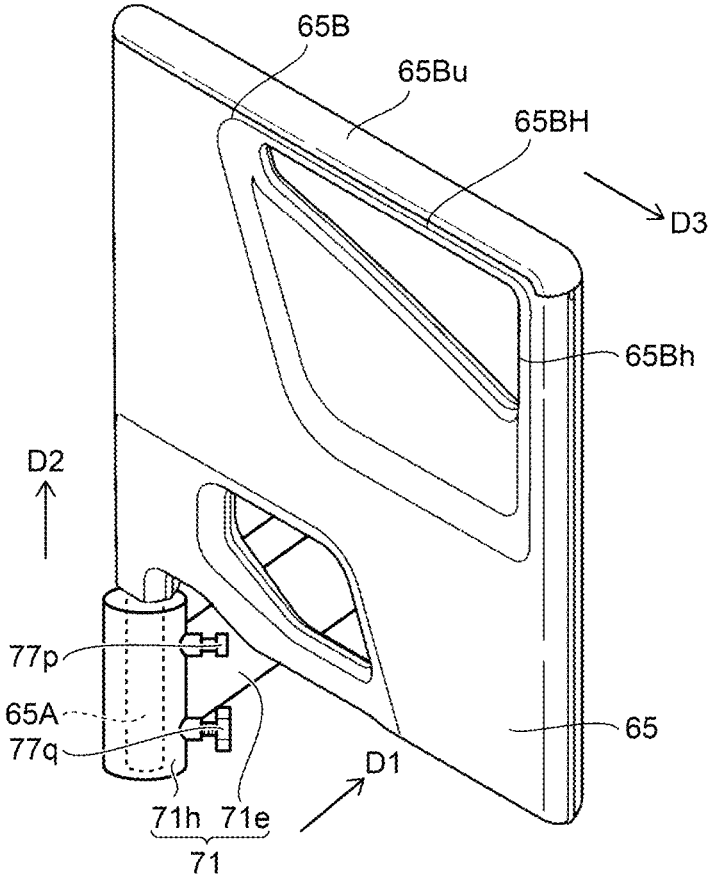
FIG. 2 is a schematic perspective view illustrating the bed apparatus according to the embodiment.
Figure 3:
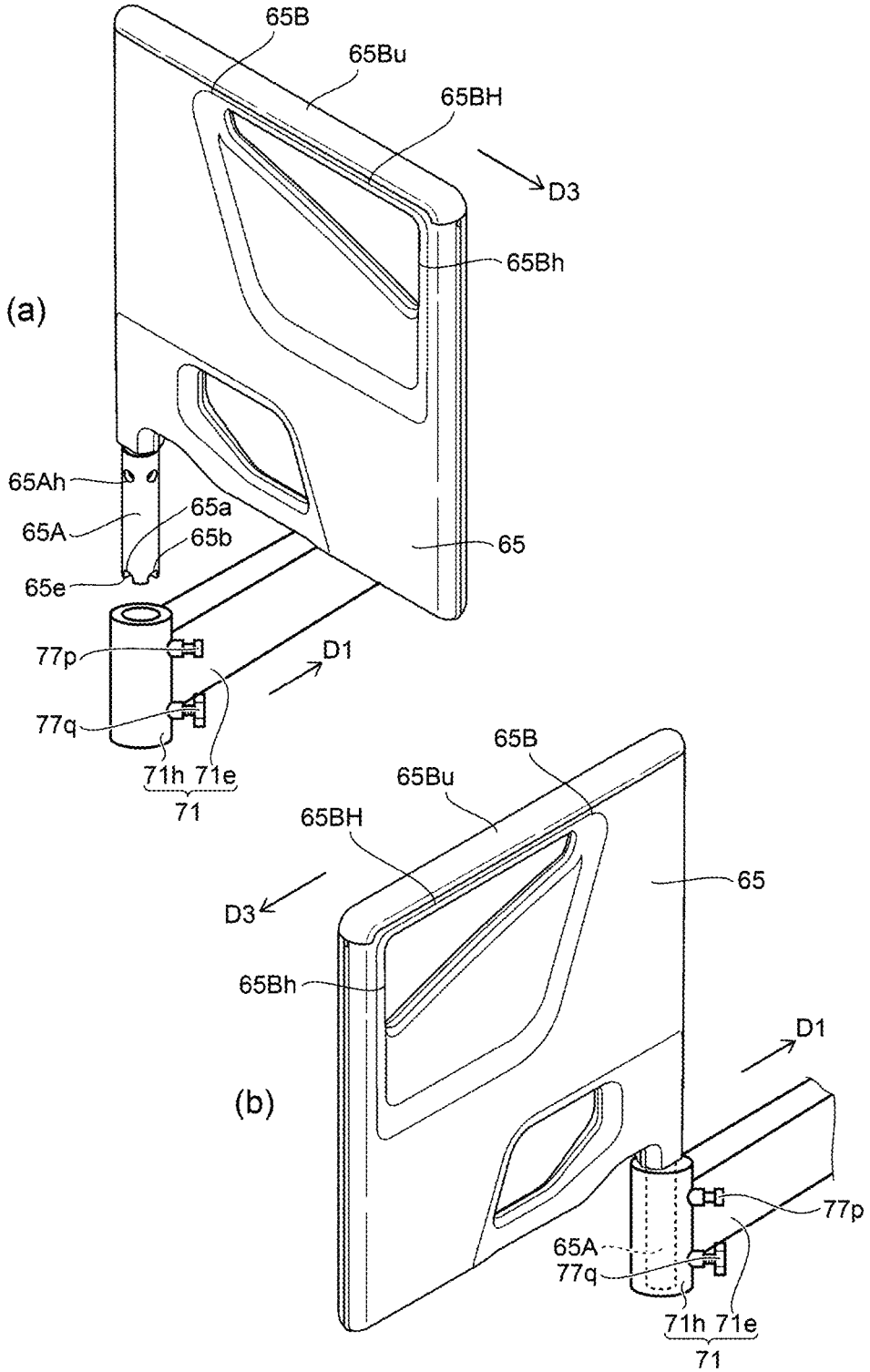
FIG. 3(*a*) and FIG. 3(*b*) are schematic perspective views illustrating the bed apparatus according to the embodiment.

FIG. 1(*a*) to FIG. 1(*c*), FIG. 2, FIG. 3(*a*), and FIG. 3(*b*) are schematic perspective views illustrating a bed apparatus according to an embodiment.

As illustrated in FIG. 1(*a*), a bed apparatus 110 includes a first frame 71 and a structure 65. In addition to these, the bed apparatus 110 may include, for example, a base frame 75B, a headboard 78A, a footboard 78B, and a mattress 78M. Additionally, a back section 70*a*, an upper leg section 70*b*, a lower leg section 70*c*, and the like may be provided.

FIG. 1(*c*) illustrates a state where the headboard 78A, the footboard 78B, the mattress 78M, and the sections, for example, are removed.

As illustrated in FIG. 1(*c*), the first frame 71, for example, is secured to the base frame 75B. The lower leg section 70*c* (see FIG. 1(*a*)), for example, is disposed on the first frame 71.

As illustrated in FIG. 1(*a*), the mattress 78M is disposed on the back section 70*a*, the upper leg section 70*b*, and the lower leg section 70*c*. A user of the bed apparatus 110 can lie on the mattress 78M.

The mattress 78M is interposed between the headboard 78A and the footboard 78B. A direction from the headboard 78A to the footboard 78B corresponds to a "longitudinal direction" of the bed apparatus 110.

As illustrated in FIG. 1(*a*), the bed apparatus 110 has a length direction Dh and a width direction Dw. For example, a length of the bed apparatus 110 in the length direction Dh is longer than a length of the bed apparatus 110 in the width direction Dw. The base frame 75B extends in the length direction Dh.

As illustrated in FIG. 1(*c*), the first frame 71 includes a holder 71*h*. The first frame 71 includes a portion extending in a first direction D1. In one example, the portion extending in the first direction D1 is an extension 71*e*. In this example, the first direction D1 is along the width direction Dw. In the embodiment, the first direction D1 may be along the length direction Dh. The first direction D1 may be inclined to the width direction Dw or the length direction Dh as suited. As illustrated in FIG. 1(*c*), the first frame 71 includes a frame body 71*r*. The frame body 71*r* includes a portion along the width direction Dw and a portion along the length direction Dh. One of these portions of the frame body 71*r* may correspond to the "portion extending in the first direction D1".

In this example, the holder 71*h* is secured to the extension 71*e*. In this example, the holder 71*h* is disposed on an end portion of the extension 71*e*.

As illustrated in FIG. 1(*a*) and FIG. 2, the structure 65 includes a first portion 65A and a second portion 65B. As illustrated in FIG. 2, the first portion 65A extends in a second direction D2. The second direction D2 intersects the first direction D1. The first portion 65A has a columnar shape extending in the second direction D2. The second direction D2 is, for example, a vertical direction (height direction).

The second portion 65B is continuous to the first portion 65A. The second portion 65B includes a portion extending in a third direction D3. The third direction D3 intersects the second direction D2.

The first portion 65A is inserted into the holder 71*h*, and the holder 71*h* holds the structure 65.

When the structure 65 is attached to the bed apparatus 110, an angle between the first direction D1 and the third direction D3 is variable. In the structure 65, for example, using the first portion 65A as an axis of rotation, a position (an angle) of the second portion 65B can be changed. For example, the structure 65 (or the second portion 65B) may have a plurality of states (such as a first state and a second state). The bed apparatus 110 may have a plurality of states (such as a first state and a second state).

In FIG. 1(*a*), the bed apparatus 110 (structure 65) is in a first state ST1. In FIG. 1(*b*), the bed apparatus 110 (structure 65) is in a second state ST2. An angle between the first direction D1 and the third direction D3 in the first state ST1 (FIG. 1(*a*)) will be referred to as first angle. In an example of FIG. 1(*a*), the first angle is substantially 90 degrees. An angle between the first direction D1 and the third direction D3 in the second state ST2 (FIG. 1(*b*)) will be referred to as second angle. In an example in FIG. 1(*b*), the second angle is substantially 0 degree or substantially 180 degrees.

As described above, in the embodiment, in the structure 65, the first angle in the first state ST1 is different from the second angle in the second state ST2. For example, in the first state ST1, the structure 65 functions as part of a side rail. For example, in the first state ST1, the structure 65 functions as a spacer of the side rail. This can prevent the user from falling from the bed apparatus 110.

For example, in the second state ST2, the user can use the second portion 65B of the structure 65 as a "grip". When the user applies the user's weight onto the second portion 65B, bed departure is consequently facilitated. In the embodiment, it is possible to provide the bed apparatus that can facilitate aid of the bed departure.

In the embodiment, the structure 65 is attached to the holder 71*h* of the first frame 71. The first frame 71 is secured to the base frame 75B and stable. This makes the structure 65 also stable. Consequently, for example, the user can apply the user's weight onto the second portion 65B of the structure 65 with a sense of security. The sense of security can further encourage bed departure.

In the embodiment, a difference between the first angle and the second angle is substantially 90 degrees (e.g., 80 degrees or larger and 100 degrees or less). For example, in the first state ST1 (see FIG. 1(*a*)), the third direction D3 is along the length direction Dh. In the second state ST2, the third direction D3 is along the width direction Dw. With such an angle setting, a function of the structure 65 as the side rail (or the spacer) can be acquired in an improved manner. A function as the "grip" can be acquired in an improved manner.

As illustrated in FIG. 1(*c*), in the embodiment, the holder 71*h* is preferably below the lower leg section 70*c*. The holder 71*h* disposed below makes it difficult for the user on the bed to detach the structure 65 and can prevent the user from falling from the bed apparatus 110. Since the holder 71*h* is below the lower leg section 70*c*, the holder 71*h* can hold the structure 65 more stably.

As illustrated in FIG. 1(*a*), a position of the holder 71*h* in the width direction Dw is preferably outside of the lower leg section 70*c* in the width direction Dw. This can prevent the holder 71*h* or the structure 65 from restricting, for example, a movement of the lower leg section 70*c*.

As illustrated in FIG. 1(*c*), the first frame 71 may include a plurality of holders 71*h*. The plurality of holders 71*h* are disposed, for example, on the left and the right of the bed apparatus 110. Both of the left and right holders 71*h* may be each provided with the structure 65. One of the left and right holders 71*h* may be provided with the structure 65.

As illustrated in FIG. 1(*a*) and FIG. 1(*b*), the bed apparatus 110 may further include a second frame 72 and a first side rail 61. The first side rail 61 is held by the second frame 72. As already described, the first frame 71 provided with the structure 65 is secured to the base frame 75B. An angle between the first frame 71 and the base frame 75B is constant. Meanwhile, an angle of the second frame 72 with respect to the base frame 75B as a reference is variable. The second frame 72 is held by the base frame 75B so as to make an angle between the second frame 72 and the base frame 75B variable.

In the embodiment, the second frame 72 may substantially be the back section 70*a*. The "second frame 72" is a member an angle of which is variable, and is a member capable of "back raising", for example. The angle is varied by an actuator and the like.

Along with a movement (back raising) of the second frame 72, the first side rail 61 moves in conjunction. In a back raised state, the user can be further prevented from falling from the bed apparatus 110. An example of the movement of the second frame 72 will be described later.

As illustrated in FIG. 1(*a*) and FIG. 1(*c*), the bed apparatus 110 may further include a third frame 73 and a second side rail 62. The third frame 73 is held by, for example, the base frame 75B. The second side rail 62 is held by the third frame 73. The second side rail 62 is interposed between the first side rail 61 and the structure 65. For example, a position of the second side rail 62 in the length direction Dh is between a position of the first side rail 61 in the length direction Dh and a position of the structure 65 in the length direction Dh.

The second side rail 62 has, for example, a third state ST3 and a fourth state ST4. As illustrated in FIG. 1(*a*), in the third state ST3, the second side rail 62 is in a raised state. As illustrated in FIG. 1(*b*), in one example of the fourth state ST4, the second side rail 62 is in a lowered state.

For example, an upper end 62*u* of the second side rail 62 in the fourth state ST4 is below the upper end 62*u* of the second side rail 62 in the third state ST3. For example, the upper end 62*u* of the second side rail 62 in the third state ST3 is above an upper surface of the mattress 78M. The upper end 62*u* of the second side rail 62 in the fourth state ST4 is below the upper surface of the mattress 78M.

In the third state ST3, the second side rail 62 can prevent the user from falling from the bed apparatus 110. In the fourth state ST4, the user can depart from the bed from a portion above the second side rail 62.

For example, when the second portion 65B of the structure 65 is in the second state ST2 (see FIG. 1(*b*)), the second side rail 62 can shift to the fourth state ST4. When the user departs from the bed through an upper side of the second side rail 62, the second portion 65B of the structure 65 is used as the grip.

For example, as illustrated in FIG. 1(*a*), preferably, a height of the upper end 62*u* of the second side rail 62 in the third state ST3 is substantially equal to a height of an upper end 65Bu of the second portion 65B of the structure 65. The structure 65 in the first state ST1 has the same height as the second side rail 62 so that the structure 65 can easily function as the spacer.

Preferably, the height of the upper end 65Bu of the second portion 65B is substantially equal to a height of an upper end 78Bu of the footboard 78B. The structure 65 can easily function as the spacer.

As illustrated in FIG. 2, in the structure 65, the second portion 65B preferably includes a grip 65BH. For example, the structure 65 has a hole 65Bh formed in a lower portion of the second portion 65B. Fingers of the user are apt to enter this hole 65Bh. For example, the hole 65Bh forms a bar-shaped portion in the second portion 65B. The bar-shaped portion serves as the grip 65BH.

As illustrated in FIG. 2, the holder 71*h* may be provided with a plunger 77*p* and a knob bolt 77*q*. For example, when the plunger 77*p* is drawn, the first portion 65A of the structure 65 can be moved in a vertical direction (the second direction D2). This makes it possible, for example, to pull out the first portion 65A (see FIG. 3(*a*)). In this example, a hole 65Ah (or a recess) where a tip of the plunger 77*p* is inserted is formed in the first portion 65A of the structure 65. For example, a force toward the hole 65Ah is exerted on the plunger 77*p* by a spring. Unless the plunger 77*p* is drawn, the tip of the plunger 77*p* is in the hole 65Ah. When the plunger 77*p* is drawn, the tip of the plunger 77*p* is detached from the hole 65Ah. This makes it possible, for example, to pull out the first portion 65A.

For example, after the first portion 65A is pulled out, a direction of the second portion 65B of the structure 65 is changed, and the first portion 65A is inserted into the holder 71*h* (see FIG. 3(*b*)). Thus, the second portion 65B of the structure 65 shifts to the second state ST2 (the angle between the first direction D1 and the third direction D3 is substantially 0 degree or substantially 180 degrees). When the plunger 77*p* is pressed toward the hole 65Ah by the spring, the tip of the plunger 77*p* enters the hole 65Ah. Thus, a movement of the first portion 65A of the structure 65 in the vertical direction is fixed.

The knob bolt 77*q*, for example, rotates. The first portion 65A is fixed by rotating the knob bolt 77*q*.

Hereinafter, examples of the holder 71*h* and the first portion 65A of the structure 65 will be described.

Figure 4:
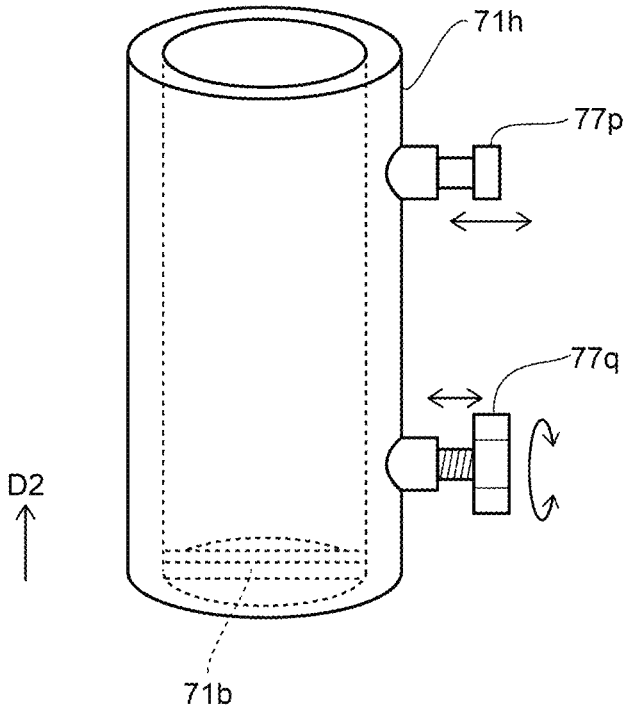
FIG. 4 is a schematic perspective view illustrating part of the bed apparatus according to the embodiment.
Figure 5:
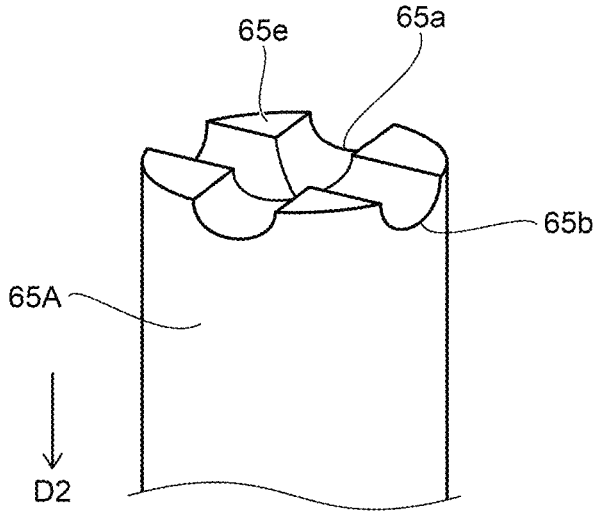
FIG. 5 is a schematic perspective view illustrating the part of the bed apparatus according to the embodiment.
Figure 6:
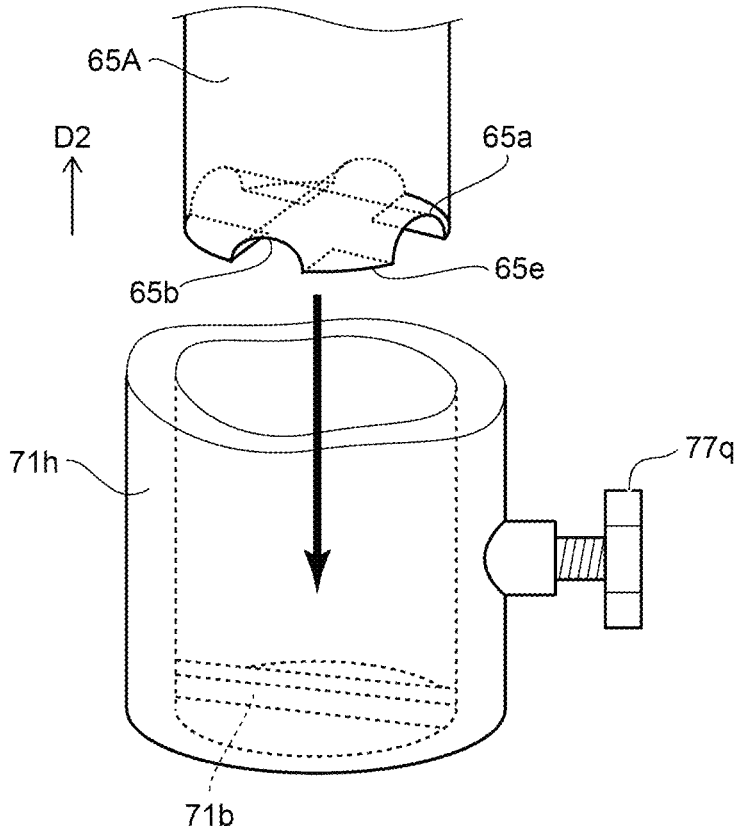
FIG. 6 is a schematic perspective view illustrating the part of the bed apparatus according to the embodiment.

FIG. 4 to FIG. 6 are schematic perspective views illustrating part of the bed apparatus according to the embodiment.

As illustrated in FIG. 4, for example, a cross bar 71*b* is disposed in a lower end of the holder 71*h*.

FIG. 5 illustrates the first portion 65A upside down. As illustrated in FIG. 5, a plurality of grooves (a first groove 65*a* and a second groove 65*b*) are formed in a lower end 65*e* (an upper end in FIG. 5) of the first portion 65A. An extending direction of the first groove 65*a* intersects an extending direction of the second groove 65*b*. In this example, the two extending directions are perpendicular to each other.

As illustrated in FIG. 6, such a first portion 65A is inserted in the holder 71*h*. One of the first groove 65*a* and the second groove 65*b* is fitted to the cross bar 71*b*. For example, when the first groove 65*a* is fitted to the cross bar 71*b*, the first state ST1 is acquired. For example, when the second groove 65*b* is fitted to the cross bar 71*b*, the second state ST2 is acquired. With this configuration, the plurality of states can be stably acquired.

In the embodiment, the number of the plurality of grooves is freely selected. An angle between the plurality of grooves is freely selected. For example, the difference between the first angle and the second angle may be other than 90 degrees.

Figure 7:
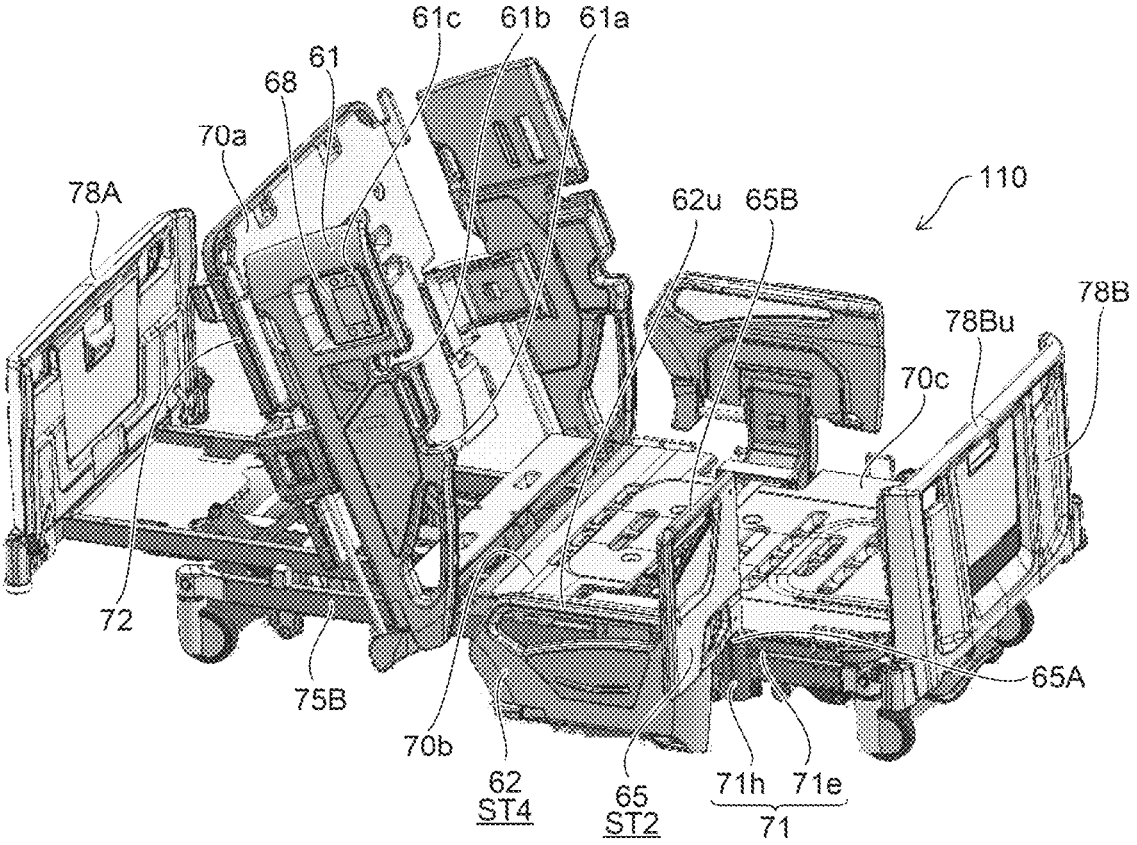
FIG. 7 is a schematic perspective view illustrating one operation state of the bed apparatus according to the embodiment.

FIG. 7 is a schematic perspective view illustrating one operation state of the bed apparatus according to the embodiment. In an example of FIG. 7, the second frame 72 (the back section 70*a*) is in a back raised state. At this time, the first side rail 61 moves to follow a movement of the second frame 72. The first side rail 61 is a follow-up side rail.

The first side rail 61 includes a first recess 61*a*. The first recess 61*a* is capable of sustaining the weight of the user of the bed apparatus 110. For example, when the second frame 72 (or the back section 70*a*) is in a back raised state, one surface of the first recess 61*a* extends in a direction close to a direction along a floor surface (a horizontal direction). It is easier for the user to put the user's hand over such a first recess 61*a*. This facilitates bed departure.

Such a first side rail 61 is on a head side of the bed apparatus 110. Meanwhile, the structure 65 is on a foot side of the bed apparatus 110. The user easily departs from the bed through a space between the first side rail 61 and the structure 65 (the portion above the second side rail 62 in this example). In an example of FIG. 7, the right hand of the user holds the first recess 61*a*. The left hand of the user holds the second portion 65B of the structure 65. This can further promote bed departure.

For example, when the first side rail 61 is in a back raised state (when the first side rail 61 is raised with respect to the base frame 75B as a reference), at least part of the first recess 61*a* of the first side rail 61 is along an extending direction of the base frame 75B.

As illustrated in FIG. 7, the first side rail 61 may further include a second recess 61*b*. For example, various kinds of wiring (including tubes and the like) of a medical apparatus are inserted in the second recess 61*b*. This can facilitate provision of safe medical care, for example.

As illustrated in FIG. 7, the first side rail 61 may further include a third recess 61*c*. For example, a bed controller 68 is held in the third recess 61*c*. For example, the user or a care worker or the like operates the bed controller 68 to control back raising or foot raising or such operation. For example, operation of the bed controller 68 may control an angle, a height, and the like of the second frame 72 (or the various sections).

For example, the bed apparatus 110 may be provided with a device such as a load cell to measure the weight of the user, for example. A measurement result and the like may be displayed in a display of the bed controller 68.

Figure 8:
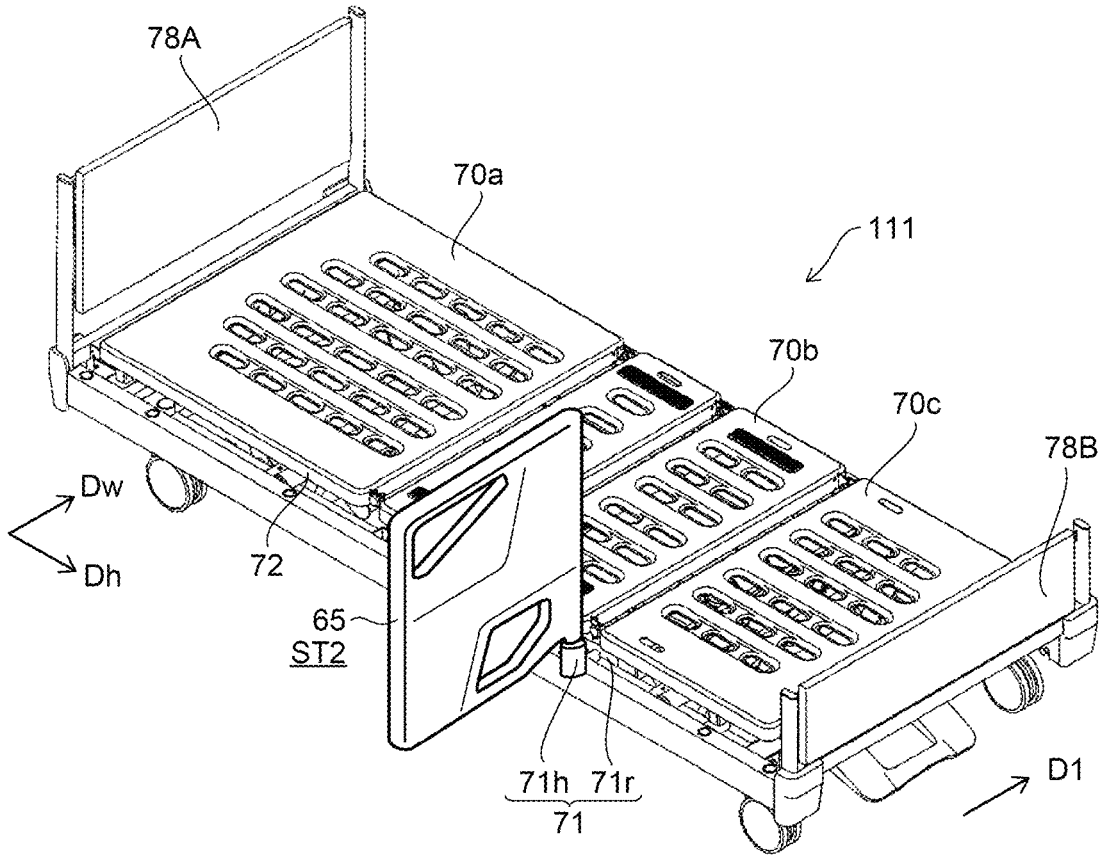
FIG. 8 is a schematic perspective view illustrating a bed apparatus according to the embodiment.

FIG. 8 is a schematic perspective view illustrating a bed apparatus according to the embodiment.

As illustrated in FIG. 8, a bed apparatus 111 according to the embodiment includes the first frame 71 and the structure 65. In addition to these, the bed apparatus 111 may include, for example, the headboard 78A and the footboard 78B. In an example of FIG. 8, the back section 70*a*, the upper leg section 70*b*, the lower leg section 70*c*, and the like are provided. The bed apparatus 111 may include, for example, the base frame 75B and the mattress 78M (see FIG. 1(*a*)). Examples of portions of the bed apparatus 111 that are different from those of the bed apparatus 110 will be described below.

In the bed apparatus 111, the first frame 71 has a portion extending in the first direction D1. In this example, the portion extending in the first direction D1 corresponds to part of the frame body 71*r* (see FIG. 1(*c*)). As already described, the frame body 71*r* includes the portion along the width direction Dw and the portion along the length direction Dh (see FIG. 1(*c*)). One of these portions of the frame body 71*r* corresponds to the "portion extending in the first direction D1".

As illustrated in FIG. 8, the bed apparatus 111 also includes the holder 71*h*. In this example, the holder 71*h* is coupled to the frame body 71*r*.

In the bed apparatus 111 as well, the structure 65 can have the first state ST1 and the second state ST2. FIG. 8 illustrates the second state ST2. In the bed apparatus 111 as well, in the structure 65, the first angle in the first state ST1 is different from the second angle in the second state ST2. For example, in the first state ST1, the user can be prevented from falling from the bed apparatus 111. For example, in the second state ST2, the user applies the user's weight onto the second portion 65B to facilitate bed departure. With bed apparatus 111 as well, it is possible to provide the bed apparatus that can facilitate aid of the bed departure.

Hereinafter, an exemplary bed apparatus according to the embodiment will be described.

Figure 9:
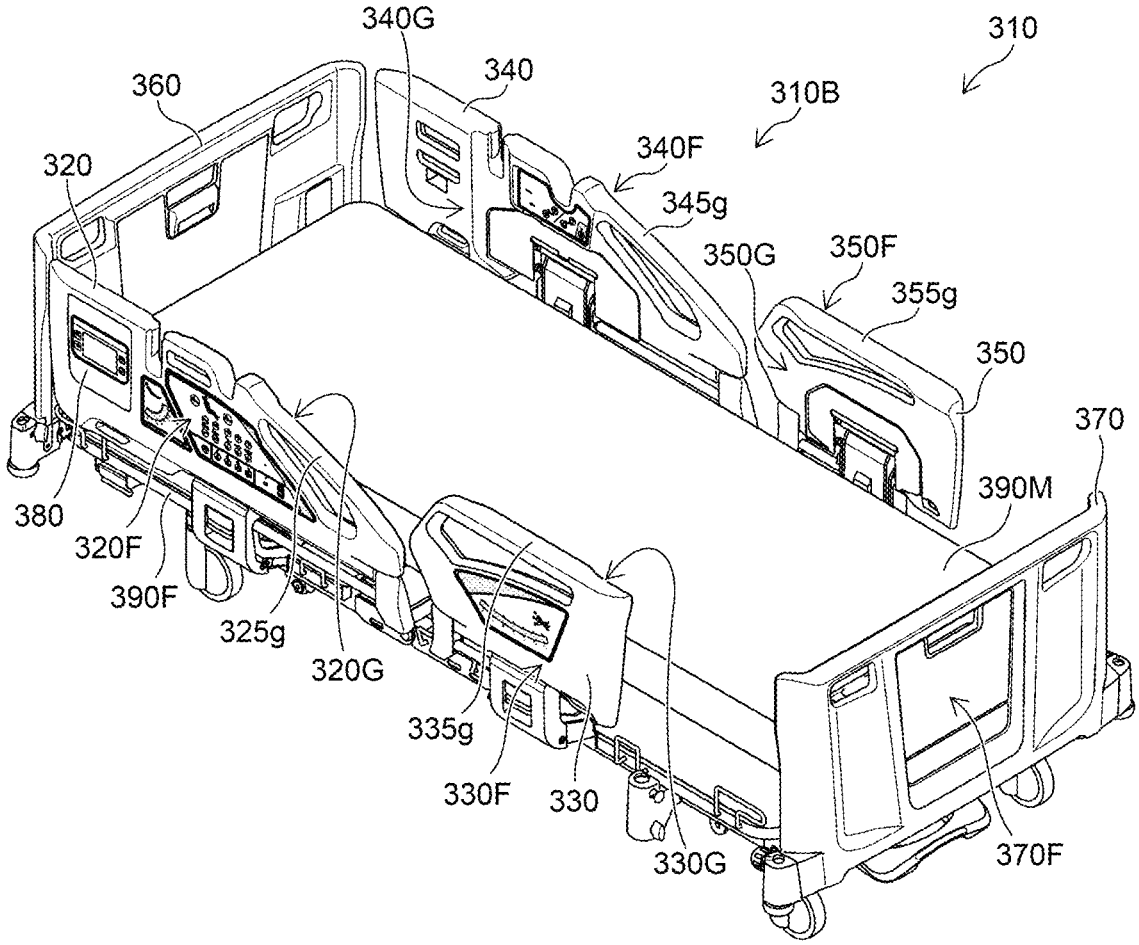
FIG. 9 is a schematic perspective view illustrating a bed apparatus according to the embodiment.

FIG. 9 is a schematic perspective view illustrating the bed apparatus according to the embodiment.

As illustrated in FIG. 9, a bed apparatus 310 includes a head right side rail 320, a foot right side rail 330, a head left side rail 340, a foot left side rail 350, a headboard 360, and a footboard 370.

These side rails are disposed on, for example, a frame 390F of a bed 310B. The sections (not illustrated in FIG. 9) are disposed on the frame 390F of the bed 310B, and a mattress 390M is disposed on the sections. A user of the bed 310B can lie on the mattress 390M. The bed apparatus 310 is used in, for example, a hospital, a care facility, or a household.

The bed apparatus 310 is, for example, a motorized bed. The bed apparatus 310 can be operated by the user of the bed apparatus 310, a care worker or the like.

Angles of the head right side rail 320 and the head left side rail 340 (e.g., angles with respect to a horizontal plane as a reference) are variable. For example, back raising or back lowering can be performed. For example, when an angle of the back section 70*a* (see FIG. 17(*b*)) is changed, the angles of the head right side rail 320 and the head left side rail 340 attached to the back section 70*a* are changed to follow the back section 70*a*.

Heights of the foot right side rail 330 and the foot left side rail 350 are variable. When the foot right side rail 330 and the foot left side rail 350 are at high positions, for example, the user can be prevented from falling from the bed 310B. When the foot right side rail 330 and the foot left side rail 350 are at low positions, for example, the user easily departs from the bed 310B through an upper side of the foot right side rail 330 and the foot left side rail 350.

The head right side rail 320 has an outer surface 320F and an inner surface 320G. The foot right side rail 330 has an outer surface 330F and an inner surface 330G. The head left side rail 340 has an outer surface 340F and an inner surface 340G. The foot left side rail 350 has an outer surface 350F and an inner surface 350G.

Various switches and the like are disposed on the outer surface 320F and the inner surface 320G of the head right side rail 320 and the outer surface 340F and the inner surface 340G of the head left side rail 340. The switches on the outer surfaces are designed to be convenient, for example, for a care worker or a medical worker (such as a medical doctor, a nurse, or a physical therapist) to operate. Various switches and the like are also disposed on these inner surfaces. The switches on the inner surfaces are designed to be convenient, for example, for the user of the bed 310B. Examples of these switches will be described later.

Handrails 325*g*, 335*g*, 345*g*, and 355*g* are disposed on respective upper portions of the head right side rail 320, the foot right side rail 330, the head left side rail 340, and the foot left side rail 350. Widths of these handrails in the vertical direction are smaller on an inner side than on an outer side. This, for example, makes it easier for the user to grasp these handrails.

In the foot right side rail 330 and the foot left side rail 350, upper surfaces of the respective handrails 335*g* and 355*g* are designed to have large widths. The user can sit on these upper surfaces (edge sitting position). Thus, when the user is in an edge sitting position, back sides of the thighs are prevented from aching.

Recesses are formed in the outer surface 320F of the head right side rail 320 and the outer surface 340F of the head left side rail 340. A bed user interface device 380 can be attached to these recesses. Moreover, the bed user interface device 380 can be attached to an outer surface 370F of the footboard 370. The bed user interface device 380 will be described later.

Hereinafter, examples of the side rails will be described.

Figure 10:
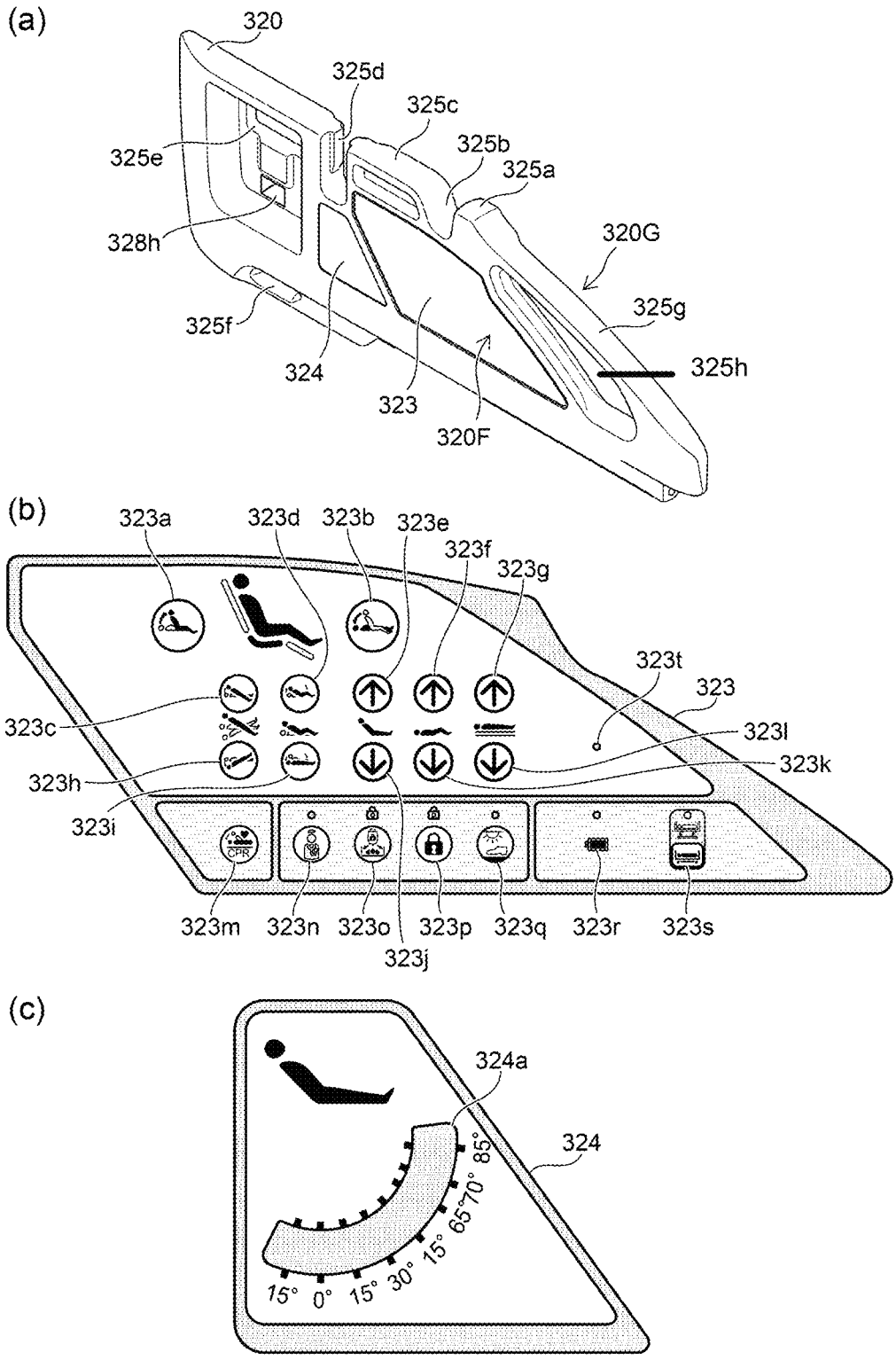
FIG. 10(*a*) to FIG. 10(*c*) are schematic diagrams illustrating part of the bed apparatus according to the embodiment.

FIG. 10(*a*) to FIG. 10(*c*) are schematic diagrams illustrating part of the bed apparatus according to the embodiment.

As illustrated in FIG. 10(*a*), a through hole 325*h* is formed in an upper portion of the head right side rail 320. The through hole 325*h* forms the handrail 325*g*.

The upper portion of the head right side rail 320 further includes a protrusion 325*a*, a recess 325*b*, a head-side protrusion 325*c*, and a head-side recess 325*d*. The protrusion 325*a* can be used as, for example, a support portion to support the body of the user. When the head right side rail 320 is raised (a back raised state), the recess 325*b* can be used as, for example, a support portion to support the body of the user.

The user easily grasps the head-side protrusion 325*c*. For example, in a back raised state or a back lowered state, the body of the user is easily supported by the head-side protrusion 325*c*. The head-side protrusion 325*c* has a though hole. Thus, the head-side protrusion 325*c* can be used as a handrail.

The head-side recess 325*d* can contain various lines for medical care. The various lines are easily made stable. The various lines for medical care include, for example, cables or tubes of a respirator and various kinds of ME equipment. The various lines are inserted in the head-side recess 325*d* so that these lines can be prevented from being tangled.

The outer surface 320F of the head right side rail 320 is provided with a switch portion 323, an angle meter 324, a through hole 325*e* (e.g., a hook portion), and a lower through hole 325*f* (e.g., a Harn bag hook). The bed user interface device 380 can be hung from the through hole 325*e*. A Harn bag can be hung from the lower through hole 325*f*. A trash box, for example, may be hung from the lower through hole 325*f*. For example, a hole 328*h* is formed below the through hole 325*e*. A cable of the bed user interface device 380 may be passed through the hole 328*h*. The cable is electrically connected to a connector disposed on the bed apparatus 310 via the hole 328*h*. The cable can be prevented from coming into contact with a floor. The cable can be shortened.

FIG. 10(*b*) illustrates the switch portion 323.

The switch portion 323 is, for example, a membrane switch (such as a membrane switch for medical workers). The switch portion 323 includes switches 323*a* to 323*q*.

When the switch 323*a* is depressed, "cardiac raising" is performed. When the switch 323*b* is depressed, "cardiac lowering" is performed. The "cardiac raising" causes the bed 310B to take a cardiac position (see FIG. 17(*b*)). By the "cardiac raising", the bed 310B is operated toward the cardiac position without decreasing an angle between the back section 70*a* and the upper leg section 70*b* to an extreme degree while keeping the upper leg section 70*b* raised from a horizontal angle. In the state where the angle between the back section 70*a* and the upper leg section 70*b* is not extremely decreased, the angle is less than 90 degrees. In the state where the angle between the back section 70*a* and the upper leg section 70*b* is not extremely decreased, the user can be prevented from receiving excessive abdominal pressure and can keep a comfortable posture. For example, when the user is inclined without raising the knees, the user may slip down in some cases. With the upper leg section 70*b* being raised from the horizontal angle, the user can be prevented from slipping down. By the "cardiac lowering", the bed 310B is operated into a state with aback angle of 0 degree, a knee angle of 0 degree, and an inclination angle of 0 degree without decreasing an angle between the back section 70*a* and the upper leg section 70*b* to an extreme degree while keeping the upper leg section 70*b* raised from the horizontal angle.

When the switch 323*c* is depressed, "reverse expansion" is performed. When the switch 323*h* is depressed, "expansion" is performed. In the "expansion", the head is lowered. In the "reverse expansion", the feet are lowered.

When the switch 323*d* is depressed, "kind raising" is performed. In the "kind raising", angles of the back section 70*a* and the upper leg section 70*b* vary in conjunction with each other. When the switch 323*i* is depressed, "kind lowering" is performed. In the "kind lowering", the angles of these sections vary in conjunction with each other. For example, when the angles of the back section 70*a* and the upper leg section 70*b* increase in conjunction with each other, the angle of the upper leg section 70*b* increases first, and thereafter, the angle of the other section increases. This minimizes displacement of a patient (user). In the "kind raising", the angle of the back section 70*a* being 70 degrees corresponds to an operation completion angle. The angle of the upper leg section 70*b* is an angle to follow the angle of the back section 70*a*.

In the "kind raising", at first, the back angle is 0 degree, and the knee angle is 0 degree. Next, the back angle becomes 5 degrees, and the knee angle is 0 degree. Next, the back angle becomes 15 degrees, and the knee angle becomes 10 degrees. Further, the back angle becomes 30 degrees, the knee angle becomes 25 degrees, the back angle becomes 50 degrees, and the knee angle becomes 25 degrees. Thereafter, the back angle becomes 70 degrees, and the knee angle becomes 0 degree. In the "kind raising", the back angle and the knee angle increase in conjunction with each other part way. When the back angle becomes a certain angle or larger, the knee angle decreases to 0 degree.

In the "kind lowering", at first, the back angle is 70 degrees, and the knee angle is 0 degree. Next, the back angle becomes 50 degrees, and the knee angle becomes 25 degrees. Further, the back angle becomes 30 degrees, and the knee angle is 25 degrees. Further, the back angle becomes 15 degrees, and the knee angle becomes 20 degrees. Further, the back angle becomes 0 degree, and the knee angle becomes 5 degrees. Thereafter, the back angle is 0 degree, and the knee angle becomes 0 degree.

When the switch 323*e* is depressed, "back raising" is performed. When the switch 323*j* is depressed, "back lowering" is performed.

When the switch 323*f* is depressed, "knee raising" is performed. When the switch 323*k* is depressed, "knee lowering" is performed.

When the switch 323*g* is depressed, "height raising" is performed. When the switch 323*l* is depressed, "height lowering" is performed. When a height of the bed 310B in an inclined state is raised, the height is raised while an inclination angle is maintained. The same applies to the "lowering". Further, when the bed 310B reaches a maximum bed height while keeping the inclined state, the bed 310B stops once. After the bed 310B stops, and when a height raising button (the switch 323*g*) is depressed again, priority is given to raising the height of the bed 310B, and the height is raised while the inclination angle is made to be 0 degree. The same applies to the "lowering".

The switches 323*c* to 323*g* for "raising" are above the switches 323*h* to 323*l* for "lowering". For example, there is a possibility that the user of the bed 310B unintentionally touches the switches of the switch portion 323. At this time, the user of the bed 310B is more likely to touch an upper portion than a lower portion. The switches 323*c* to 323*g* for "raising" are on an upper side so that even when the user erroneously touches the upper portion, a risk can be suppressed as compared with the case of touching the switches 323*h* to 323*l*.

When the switch 323*m* is depressed, "CPR lowering" is performed. In the "CPR lowering", the bed is in a state suitable for cardio pulmonary resuscitation (CPR). In the "CPR lowering" state, the upper leg section 70*b* and the lower leg section 70*c* become flat. In the "CPR lowering", the bed height of the bed 310B is lowered. In the case of an inclined state, an inclination angle also becomes 0 degree. For example, an operation sequence is as follows. The back angle is made to be 0 degree (while the back section 70*a* is being moved, the upper leg section is also made to be close to 0 degree). Next, the inclination angle is made to be 0 degree. Next, the height is lowered. Next, the knee angle is made to be 0 degree. For example, the bed 310B may be in a state where the bed height is lowest. For example, the bed 310B may be provided with a temporary stop position (a temporary stop height) by the operation of "height lowering". In a state prior to the "CPR lowering", when the height is larger than the temporary stop height, the "CPR lowering" is performed to cause the height of the bed 310B to be the temporary stop height. At the temporary stop height, a distance from the floor to upper surfaces of the sections is approximately 42 cm.

In one example, when the switch 323*m* is "depressed and held", the "CPR lowering" is performed. Time of "depressing and holding" is 2 seconds or longer, for example. In another example, when the switch 323*m* is "depressed twice", the "CPR lowering" is performed. When the switch 323*m* is "depressed twice", time between "first depressing" and "second depressing" is 5 seconds or less.

Concerning operations other than CPR operations, an operation is started when a button is depressed. In an emergency, to quickly perform a CPR operation, an operator of the button for the CPR operation (switch 323*m*) may hesitate to depress the button for the CPR operation. As described above, for example, the CPR operation is performed by "depressing and holding" or "depressing twice" the switch 323*m*. Thus, the CPR operation can be performed with less hesitation.

The "CPR lowering" is an electric CPR operation. Other than this, a manual CPR operation may be performed.

The switch 323*n* is a "nurse call". When the switch 323*n* is depressed, nurse call dispatch is performed. Information is transmitted to a nurse call system.

When the switch 323*o* is depressed, an operation of a switch (described later) disposed on the inner surface 320G of the head right side rail 320 shifts to an "inhibited state". When the switch 323*p* is depressed, all operations concerning movements (actuators) of the bed 310B shift to "inhibited states". In this case, the "nurse call" and a foot lamp, for example, can be operated.

When the switch 323*q* is depressed, the foot lamp provided for the bed 310B, for example, is lit.

In this example, the switch portion 323 includes indicators 323*r* to 323*t*. The indicator 323*r* indicates a remaining capacity of a battery. The indicator 323*s* is lit (e.g., orange colored) when the bed height is not the minimum. The indicator 323*s* is unlit when the bed height is the minimum.

The indicator 323*t* displays an error. Normally, the indicator 323*t* is unlit. At the time of "U-system abnormality", the indicator 323*t* is lit for 1 second and unlit for 1 second repeatedly. At the time of "H-system abnormality", the indicator 323*t* is repeatedly lit for 0.2 second and unlit for 0.2 second.

Operation by the switch portion 323 (e.g., membrane switches for medical workers) on the outer surface 320F has priority to operation by a switch portion (e.g., membrane switches for the user), described later, disposed on the inner surface 320G. For example, when the outer and inner switches are simultaneously depressed, neither operation is performed. For example, when back raising is performed by the outer switch, and when the inner knee raising button is depressed, the bed 310B is stopped. When both of the buttons are released and depressed again, the bed 310B is operated.

FIG. 10(*c*) illustrates the angle meter 324 disposed on the outer surface 320F of the head right side rail 320.

A recess is formed in the head right side rail 320, and a sphere (such as a metal sphere) is disposed in the recess so as to constitute the angle meter 324. When the back section is raised, the sphere rolls in the recess. In accordance with a position of the sphere, angle display in a display 324*a* of the angle meter 324 varies. An overview of the back angle can be known from the angle meter 324.

Figure 11:
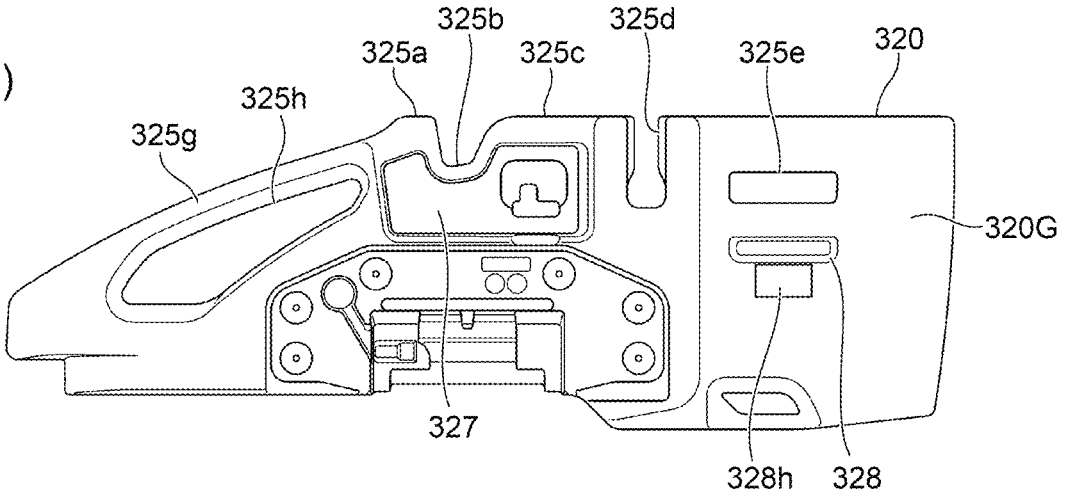
FIG. 11(*a*) and FIG. 11(*b*) are schematic diagrams illustrating part of the bed apparatus according to the embodiment.
Figure 11:
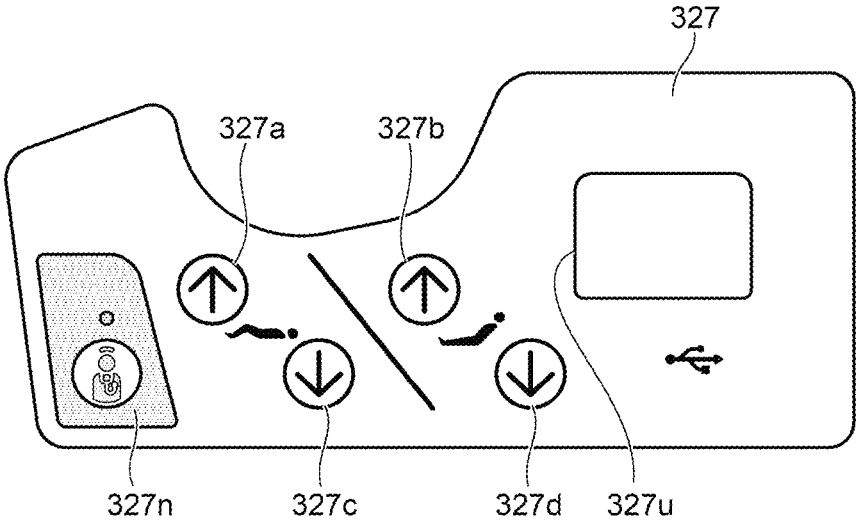

FIG. 11(*a*) and FIG. 11(*b*) are schematic diagrams illustrating part of the bed apparatus according to the embodiment.

As illustrated in FIG. 11(*a*), a recess 328 is formed in the inner surface 320G of the head right side rail 320. The recess 328 can be used as a hook. The hole 328*h* is formed below the recess 328. Further, a switch portion 327 is disposed on the inner surface 320G. The switch portion 327 is, for example, a membrane switch (e.g., a membrane switch for the user or a membrane switch for the patient).

As illustrated in FIG. 11(*b*), the switch portion 327 includes switches 327*a* to 327*d*. The switch portion 327 may include a switch 327*n*.

When the switch 327*a* is depressed, "foot raising" is performed. When the switch 327*c* is depressed, "foot lowering" is performed.

When the switch 327*b* is depressed, "back raising" is performed. When the switch 327*d* is depressed, "back lowering" is performed.

The switch 327*n* is disposed on the inner surface 320G. The switch 327*n* is "nurse call".

A USB terminal 327*u* is disposed on the inner surface 320G. A USB plug can be inserted into the USB terminal 327*u* to perform charging, for example.

The above-described configuration of the head right side rail 320 is also applied to the head left side rail 340.

Figure 12:
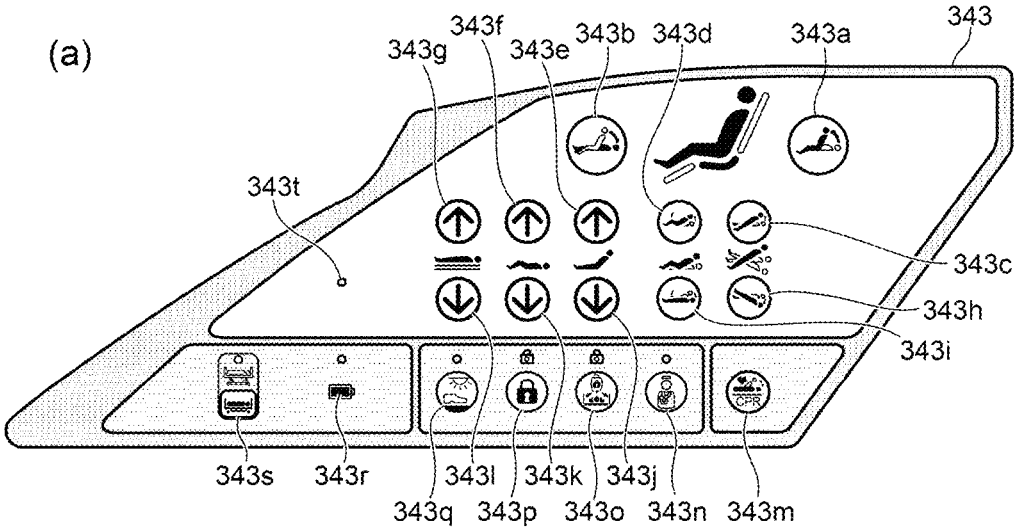
FIG. 12(*a*) to FIG. 12(*c*) are schematic diagrams illustrating part of the bed apparatus according to the embodiment.
Figure 12:
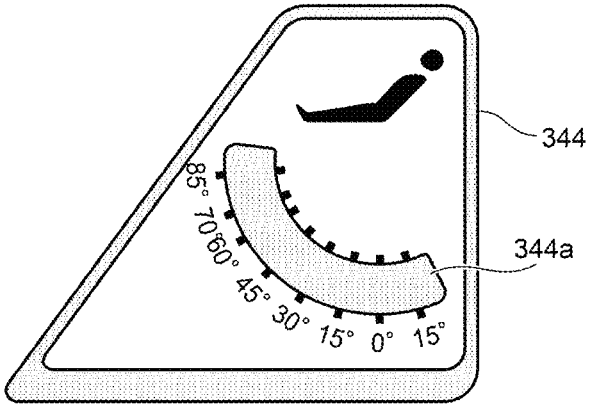
Figure 12:
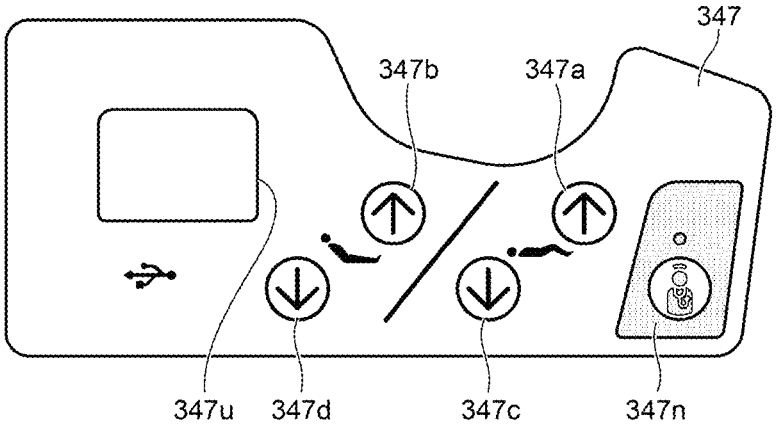

FIG. 12(*a*) to FIG. 12(*c*) are schematic diagrams illustrating part of the bed apparatus according to the embodiment.

FIG. 12(*a*) and FIG. 12(*b*) illustrate a switch portion 343 and an angle meter 344 that are disposed on an outer surface 340F of the head left side rail 340. As illustrated in FIG. 12(*a*), the switch portion 343 includes switches 343*a* to 343*q*. The switches 343*a* to 343*q* have substantially the same functions as the switches 323*a* to 323*q*. In this example, the switch portion 343 includes indicators 343*r* to 343*t*. The indicators 343*r* to 343*t* have substantially the same functions as the indicators 323*r* to 323*t*.

FIG. 12(*b*) illustrates the angle meter 344. The angle meter 344 has substantially the same configuration and function as the angle meter 324. An overview of the back angle can be known from a display 344*a* of the angle meter 344.

As illustrated in FIG. 12(*c*), the switch portion 347 is disposed on the inner surface 340G (see FIG. 9) of the head left side rail 340. The switch portion 347 has substantially the same configuration and function as the switch portion 327. The switch portion 347 includes switches 347*a* to 347*d*. The switches 347*a* to 347*d* have substantially the same functions as the switches 327*a* to 327*d*. A switch 347*n* and a USB terminal 347*u* are disposed on the inner surface 320G. The USB terminal 347*u* may be omitted.

Figure 13:
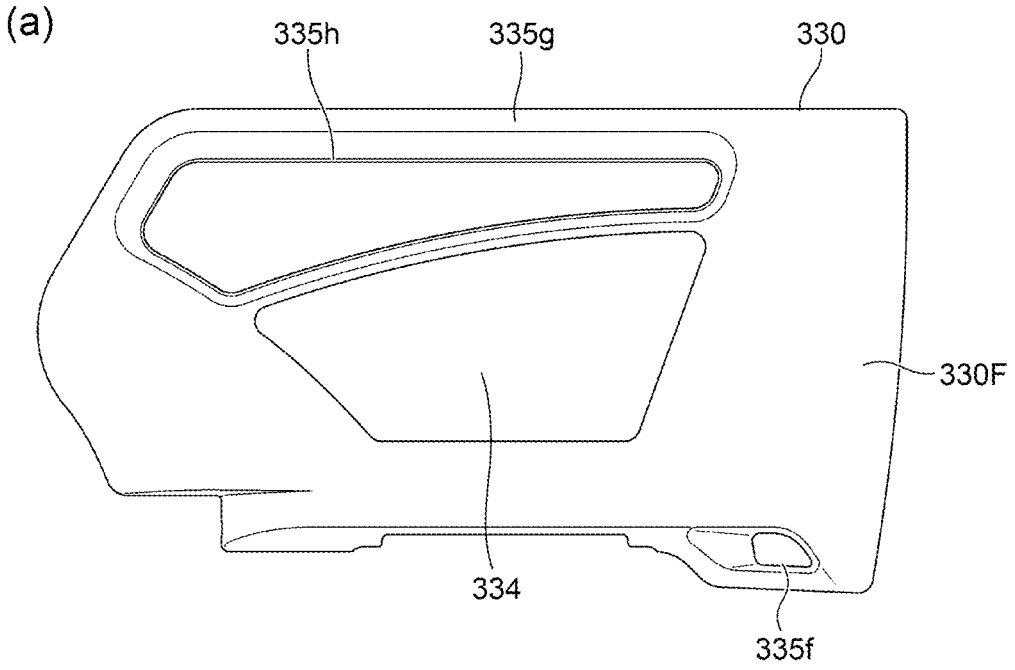
FIG. 13(*a*) and FIG. 13(*b*) are schematic diagrams illustrating part of the bed apparatus according to the embodiment.
Figure 13:
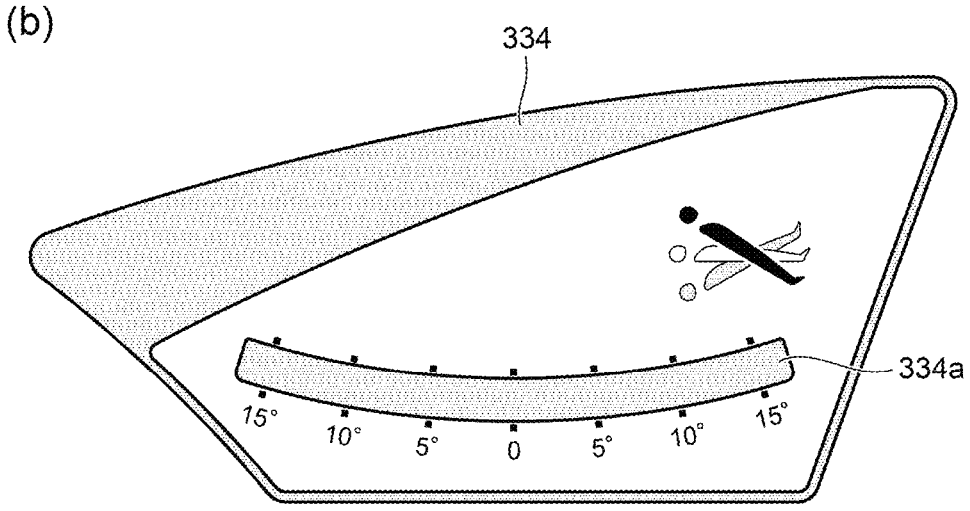

FIG. 13(*a*) and FIG. 13(*b*) are schematic diagrams illustrating part of the bed apparatus according to the embodiment.

As illustrated in FIG. 13(*a*), the foot right side rail 330 is provided with the handrail 335*g*. The handrail 335*g* is formed by a through hole 335*h*. A lower through hole 335*f* (e.g., a Harn bag hook) is formed in a lower portion of the foot right side rail 330. A Harn bag, for example, can be hung from the lower through hole 335*f*.

An angle meter 334 is disposed on the outer surface 330F of the foot right side rail 330 (see FIG. 13(*b*)). The angle meter 334 has substantially the same configuration as the angle meter 324. An overview of an angle can be known from a display 334*a* of the angle meter 334.

Figure 14:
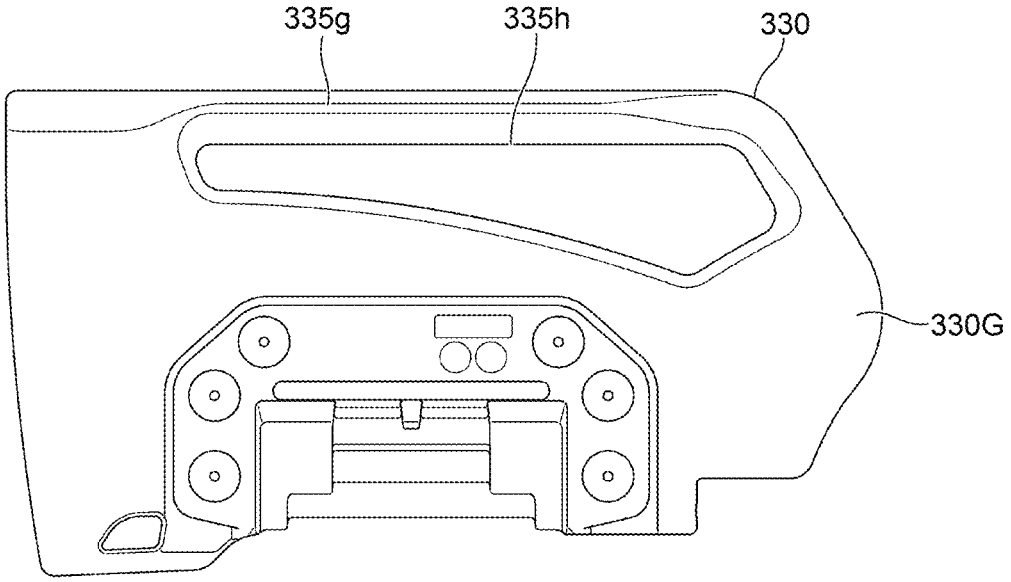
FIG. 14 is a schematic diagram illustrating part of the bed apparatus according to the embodiment.

FIG. 14 is a schematic diagram illustrating part of the bed apparatus according to the embodiment.

As illustrated in FIG. 14, the through hole 335*h* is formed in the foot right side rail 330 so as to acquire the handrail 335*g*.

Figure 15:
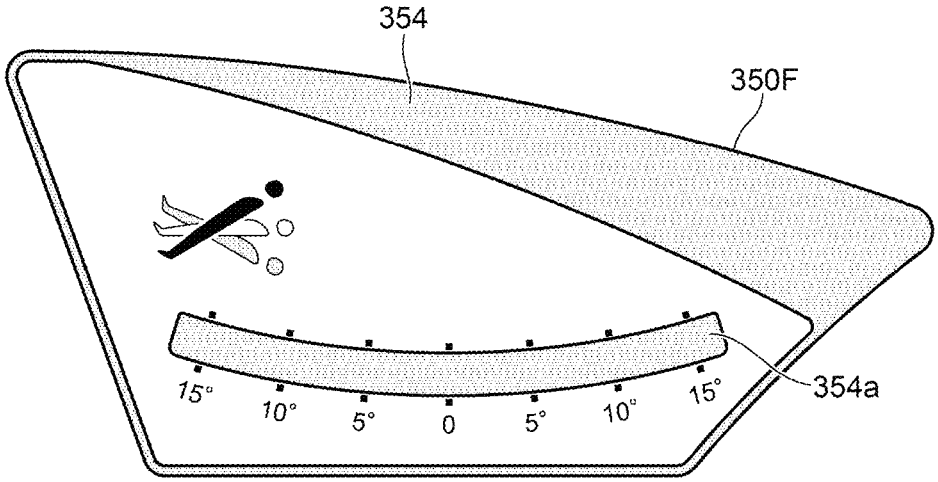
FIG. 15 is a schematic diagram illustrating part of the bed apparatus according to the embodiment.

FIG. 15 is a schematic diagram illustrating part of the bed apparatus according to the embodiment.

FIG. 15 illustrates an angle meter 354 disposed on the outer surface 350F of the foot left side rail 350. The angle meter 354 has substantially the same configuration as the angle meter 324. An overview of an angle can be known from a display 354*a* of the angle meter 354.

Figure 16:
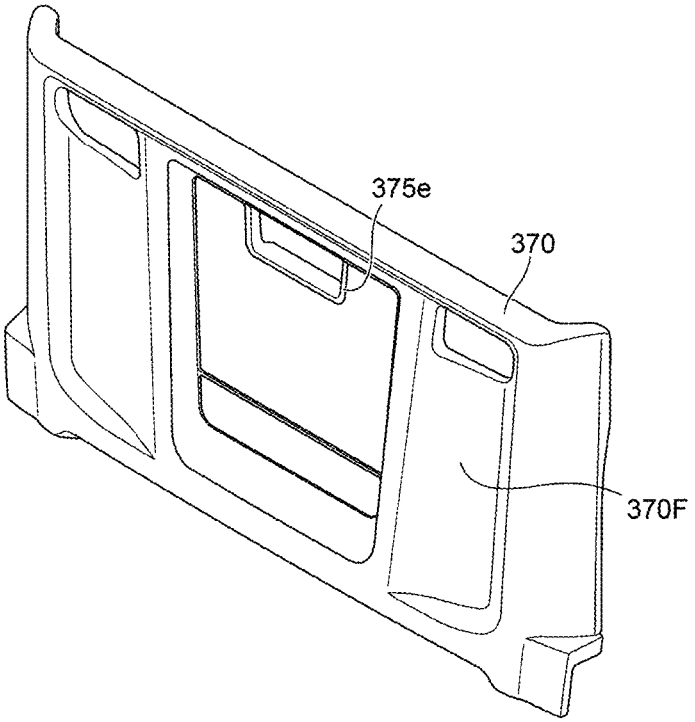
FIG. 16(*a*) and FIG. 16(*b*) are schematic diagrams illustrating part of the bed apparatus according to the embodiment.
Figure 16:
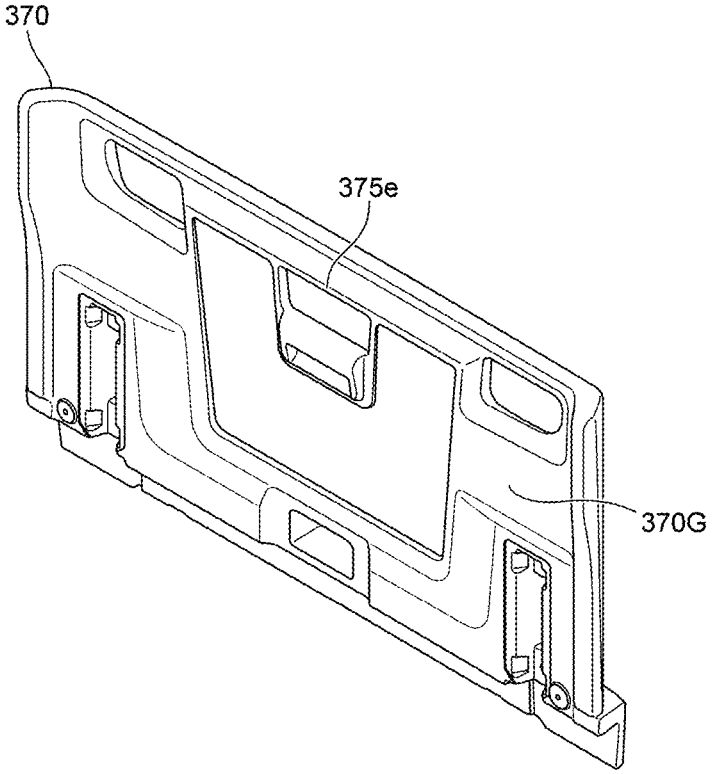

FIG. 16(*a*) and FIG. 16(*b*) are schematic diagrams illustrating part of the bed apparatus according to the embodiment.

As illustrated in FIG. 16(*a*), a through hole 375*e* (e.g., a hook portion) is formed in the outer surface 370F of the footboard 370. The bed user interface device 380 can be hung from the through hole 375*e*. As illustrated in FIG. 16(*b*), the through hole 375*e* extends through to an inner surface 370G of the footboard 370.

In the bed user interface device 380, various kinds of setting concerning the bed 310B and the weight of the user can be displayed. As a "physical button" in the bed user interface device 380, a "home button" is provided. An example of the bed user interface device 380 will be described later.

Figure 17:
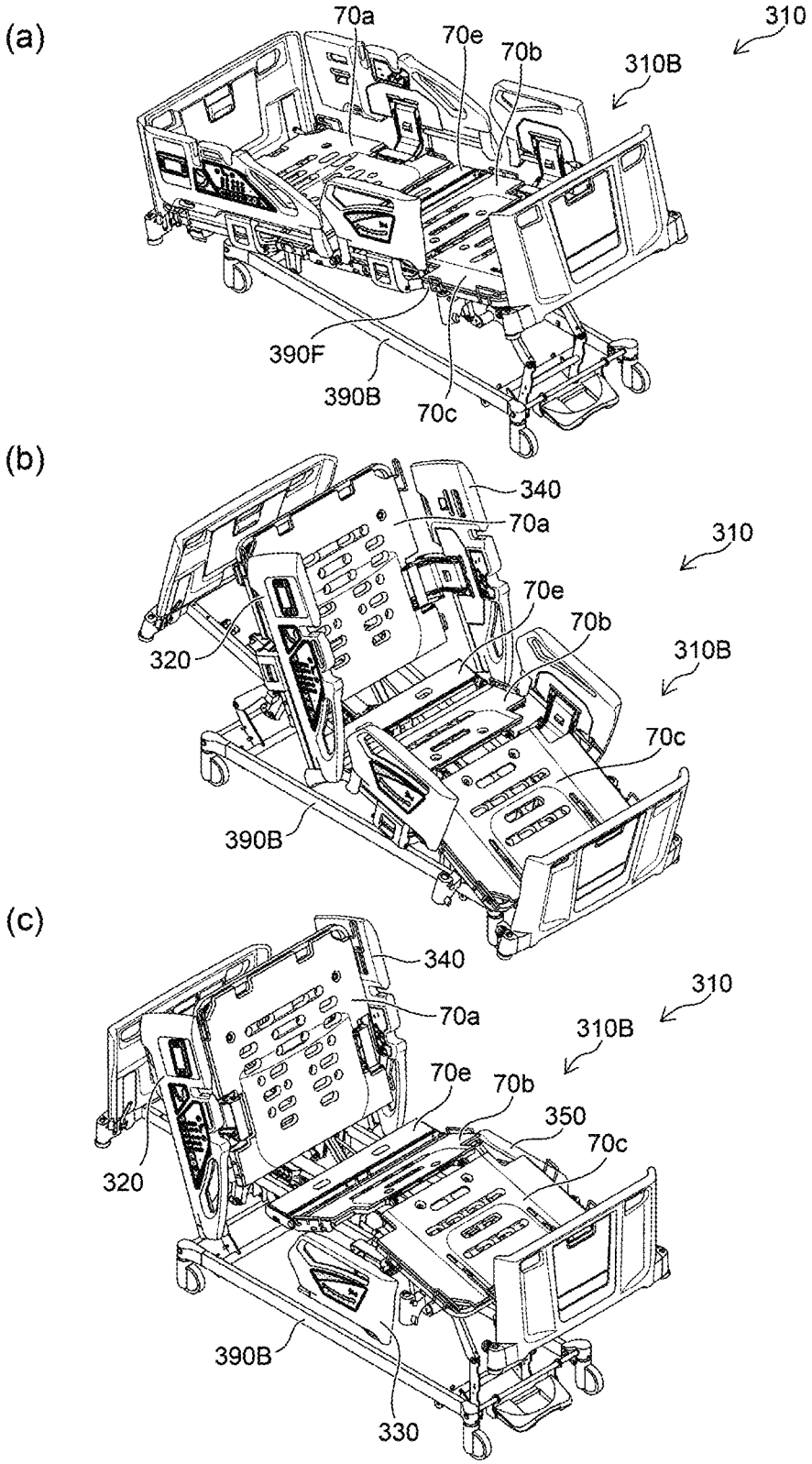
FIG. 17(*a*) to FIG. 17(*c*) are schematic perspective views illustrating operation of the bed apparatus according to the embodiment.

FIG. 17(*a*) to FIG. 17(*c*) are schematic perspective views illustrating operation of the bed apparatus according to the embodiment.

These drawings illustrate states where the mattress 390M is not provided.

As illustrated in FIG. 17(*a*), in the bed 310B, the frame 390F is attached to a base frame 390B. The back section 70*a* (back section), the upper leg section 70*b* (upper leg section), and the lower leg section 70*c* (lower leg section), for example, are disposed on the frame 390F. In this example, a seat section 70*e* is provided. The base frame 390B may be provided with casters 390C.

As illustrated in FIG. 17(*a*), in the bed apparatus 310, an angle (an inclination) of the frame 390F is variable. The inclination may include lateral inclination in addition to fore-and-aft inclination.

As illustrated in FIG. 17(*b*), in the bed apparatus 310, an angle of each of the back section 70*a*, the upper leg section 70*b*, and the lower leg section 70*c* is variable. Angles of the head right side rail 320 and the head left side rail 340 change in accordance with a change in angle of the back section 70*a*. The head right side rail 320 and the head left side rail 340 are follow-up side rails. A state of FIG. 17(*b*) corresponds to the cardiac position.

In an example of FIG. 17(*b*), the foot right side rail 330 and the foot left side rail 350 are in "raised states".

As illustrated in FIG. 17(*c*), the foot right side rail 330 and the foot left side rail 350 can shift to "lowered states".

As illustrated in FIG. 17(*b*) and FIG. 17(*c*), the height of the bed 310B is variable. The height corresponds to, for example, a distance between an upper surface of the bed 310B (e.g., upper surfaces of the sections) and the floor surface.

Figure 18:
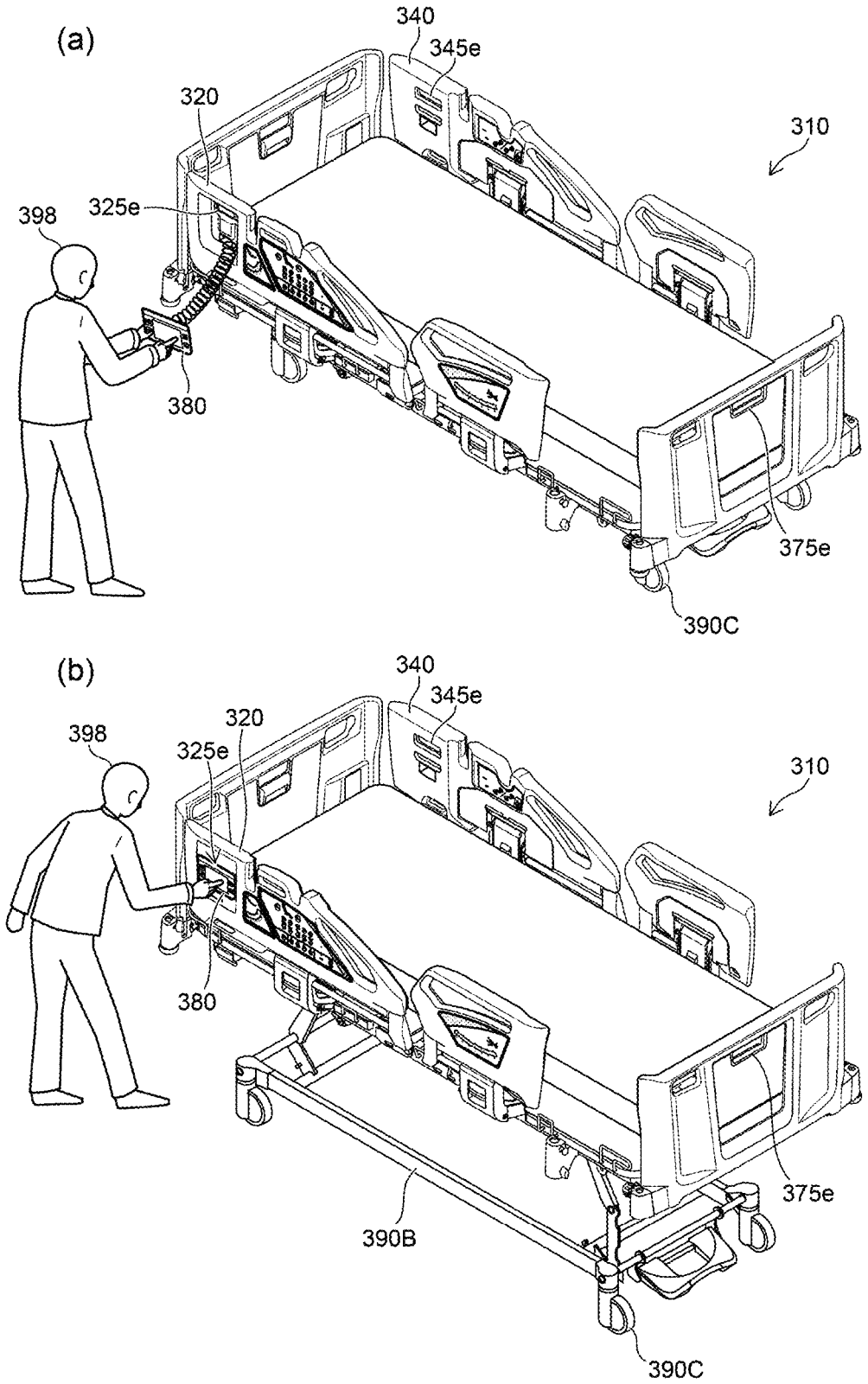
FIG. 18(*a*) and FIG. 18(*b*) are schematic perspective views illustrating use states of the bed apparatus according to the embodiment.

FIG. 18(*a*) and FIG. 18(*b*) are schematic perspective views illustrating use states of the bed apparatus according to the embodiment.

FIG. 18(*a*) illustrates a low state of the bed 310B. At this time, a care worker or the like 398 (e.g., a care worker or a medical worker) can operate the bed user interface device 380 in a state detached from the hook portion (e.g., the through hole 325*e* of the head right side rail 320).

FIG. 18(*b*) illustrates a high state of the bed 3108. At this time, the care worker or the like 398 can operate the bed user interface device 380 in a state attached to the hook portion. The bed user interface device 380 may be attached to, for example, three hook portions. The three hook portions are the through hole 325*e* of the head right side rail 320, the through hole 345*e* of the head left side rail 340, and the through hole 375*e* of the footboard 370.

Hereinafter, exemplary electrical components in the bed apparatus 310 will be described.

Figure 19:
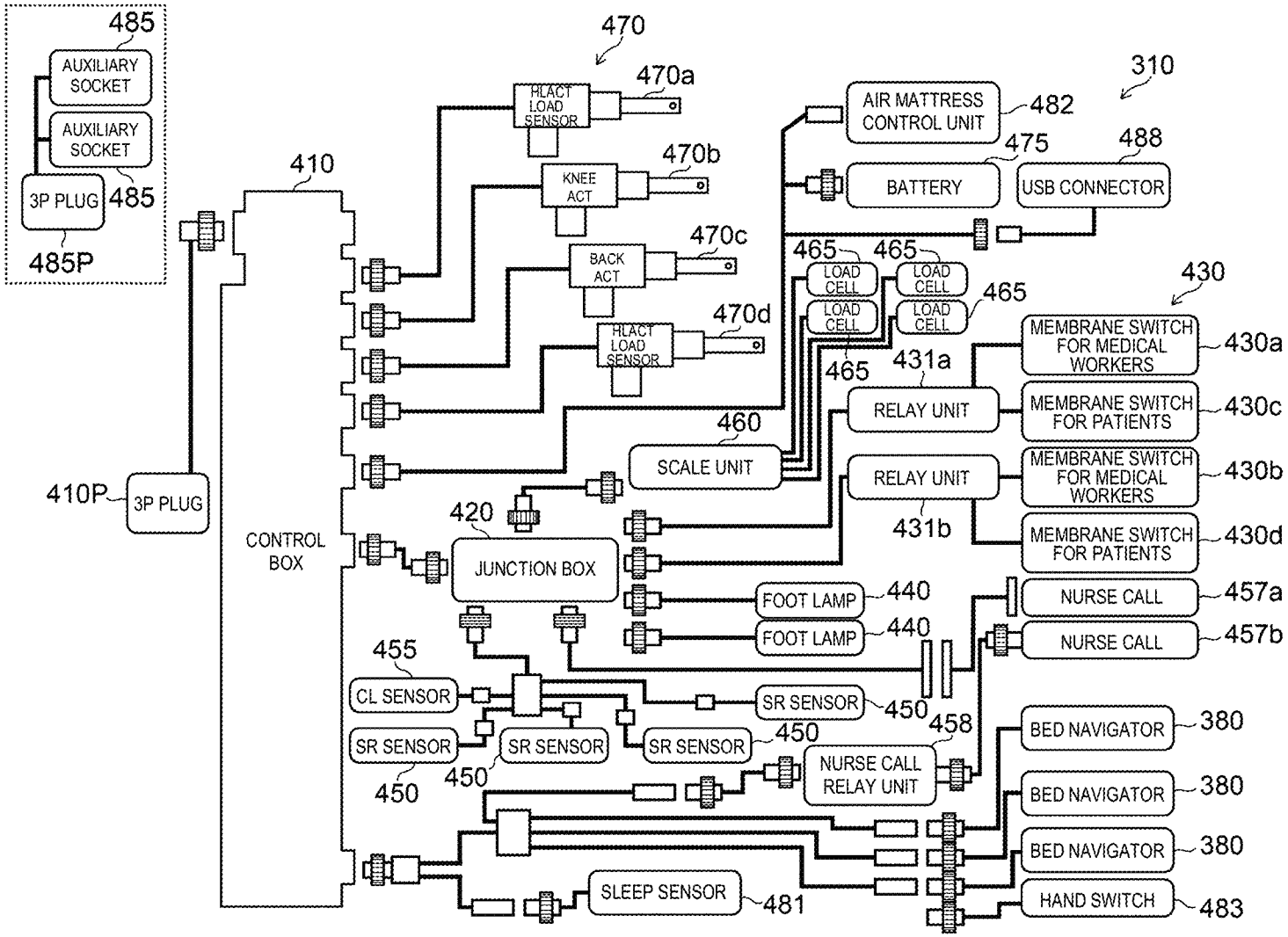
FIG. 19 is a schematic diagram illustrating the bed apparatus according to the embodiment.

FIG. 19 is a schematic diagram illustrating the bed apparatus according to the embodiment.

As illustrated in FIG. 19, a control box 410 is disposed in the bed apparatus 310. In addition to this, various devices are disposed in the bed apparatus 310. The various devices include, for example, a junction box 420, a membrane switch 430, foot lamps 440, side rail sensors 450 (SR sensors), a caster lock sensor 455 (a CL sensor), a nurse call 457*a*, a nurse call 457*b*, a nurse call relay unit 458, a scale unit 460, load cells 465, an actuator 470, and a battery 475. Some of the various devices may be omitted.

The control box 410 is connectable to the various devices. Connection between the control box 410 and the various devices is direct or via the junction box 420. The control box 410 controls bed operation and various functions. The control box 410 serves as a master of serial communication in the bed apparatus 310.

The control box 410 is provided with a plug 410P (e.g., 3-pin plug). Power is supplied from the plug 410P to the control box 410. Power is supplied from the control box 410 to the various devices.

The junction box 420 relays connection between the control box 410 and the rest of the various devices.

The membrane switch 430 includes membrane switches for medical workers 430*a* and 430*b*. These membrane switches correspond to the switches 323 and 343. The membrane switch 430 includes membrane switches for patients 430*c* and 430*d*. These membrane switches correspond to the switches 327 and 347. The membrane switch for medical workers 430*a* and the membrane switch for patients 430*c* are connected to the junction box 420 via a relay unit 431*a*. The membrane switch for medical workers 430*b* and the membrane switch for patients 430*d* are connected to the junction box 420 via a relay unit 431*b*.

The membrane switches for medical workers 430*a* and 430*b* are provided with bed operation buttons (switches). As already described, the bed operation buttons include, for example, a cardiac operation button (such as a conjunctional operation button), an expansion/reverse expansion button, a kind motion operation button (e.g., another conjunctional operation button), a CPR button, a nurse call button, a membrane switch for patients inhibition button, and an all switch inhibition button. With these bed operation buttons, operation described concerning the switch portions 323 and 343 is performed.

The membrane switches for patients 430*c* and 430*d* are provided with bed operation buttons. As already described, the bed operation buttons include, for example, aback section operation button, an upper leg section operation button, and a nurse call button. The membrane switches for patients 430*c* and 430*d* may include, for example, charging terminals.

In the membrane switches for medical workers 430*a* and 430*b* and the membrane switches for patients 430*c* and 430*d*, the bed operation buttons are disposed at intermediate positions in the vertical direction. When the bed operation buttons are disposed at lower positions, the bed operation buttons are difficult to operate. When the bed operation buttons are disposed at upper positions, the bed operation buttons may be erroneously operated. Since the bed operation buttons are disposed at intermediate positions in the vertical direction, the bed operation buttons can be easily operated and prevented from being erroneously operated.

Foot lamp buttons correspond to the switches 323*q* and 343*q*. When the foot lamp buttons are depressed, the foot lamps 440 are lit. The foot lamps 440 illuminate, for example, end portions of the bed 310B to the floor surface. The foot lamps 440 are provided, for example, one on each of the left and right sides of the bed 310B. The foot lamps 440 are disposed, for example, on left and right end portions of a rear side (a lower side) of the seat section 70*e*. The foot lamps 440 may be disposed on other portions, such as the back section 70*a*, the upper leg section 70*b*, and the lower leg portion 70*c* (see, for example, FIG. 17(*b*)). For example, each time the foot lamp buttons (the switches 323*q* and 343*q*) are depressed, the foot lamps 440 are unlit, lit dimly, lit brightly, and unlit in sequence repeatedly. For example, the foot lamps 440 are lit by a medical worker. For example, when the user goes to a toilet highly frequently, a medical worker turns on the foot lamps 440 before the user falls asleep. For example, when bed departure is detected or when a nurse call is dispatched, a medical worker turns on the foot lamps 440.

For example, when the user of the bed 310B leaves the bed for a toilet or some other place at night, the foot lamps 440 are lit. At this time, it is dark in the room in many cases. When the foot lamps 440 are abruptly lit brightly, brightness will be a nuisance to those who are asleep in the vicinity. When the foot lamps 440 are first lit dimly, the nuisance is suppressed.

The side rail sensors 450 detect whether the respective side rails are raised. The four side rail sensors 450 are provided. The four side rail sensors 450 include a head right side rail sensor, a head left side rail sensor, a foot right side rail sensor, and a foot left side rail sensor. A detection result is displayed, for example, in a terminal at a nurses' station. The detection result may be displayed in the bed user interface device 380. Based on the detection result, a warning beep may sound. As the side rail sensors 450, for example, magnetic sensors or atmospheric sensors are employed. As the side rail sensors 450, other sensors may be employed.

The caster lock sensor 455 detects whether the casters 390C are locked. As the caster lock sensor 455, for example, a magnetic sensor is employed. For example, the casters 390C are provided with bars or the like that operate in conjunction with locking and lock release of the casters 390C. States of the bars are detected to detect lock states of the casters 390C. A detection result by the caster lock sensor 455 is displayed, for example, in a terminal at a nurses' station. The detection result may be displayed in the bed user interface device 380. Based on the detection result by the caster lock sensor 455, a warning beep may sound.

The nurse call 457*a* is connected to the junction box 420. The nurse call 457*b* is connected to the nurse call relay unit 458. The nurse call relay unit 458 enables conjunctional operation with nurse calls (e.g., the nurse call 457*b*) disposed in a hospital and a facility. The nurse calls 457*a* and 457*b* are nurse calls produced domestically or overseas. For example, the nurse call 457*a* is a foreign product. For example, the nurse call 457*b* is a domestic product.

The load cells 465 are disposed at four corners of the bed 310B. The four load cells 465 are used. The load cells 465 and the scale unit 460 can measure the weight of the user.

The actuator 470 includes, for example, an actuator 470*a* for height change ("HLACT"), an actuator 470*b* for the upper leg section 70*b* ("knee ACT"), an actuator 470*c* for the back section 70*a* ("back ACT" with the CPR), and an actuator 470*d* for height change ("HLACT"). The actuators 470*a* and 470*d* include load sensors.

In one example, the actuator 470*c* for the back section 70*a* includes a mechanical mechanism to manually perform lowering operation (hereinafter referred to as manual CPR mechanism). With the manual CPR mechanism, in an emergency, the back section 70*a* can be manually lowered. For example, an exclusive-use lever is provided, and this lever is operated to manually lower the back section 70*a* so that a posture for the CPR can be acquired. For example, manually, a brake plate of the actuator 470*c* for the back section 70*a* can be displaced. Thus, a brake of the actuator 470*c* is released, and the back section 70*a* is lowered under its own weight.

The actuators 470 become a drive source to adjust movable parts that the bed 310B includes. The actuators 470 move extendable rods to operate the movable parts through a link mechanism, for example. Each of the actuators is provided with a position sensor. The control box 410 reads positional information. The load sensors of the actuators 470 may determine a movement (including bed departure, for example) by the user (e.g., a patient) on the bed 310B.

The battery 475 supplies power at the time of power breakdown or during transfer of the bed 310B, for example. In a situation without power supply, a desired operation can be acquired. A change switch may be provided to charge or not charge the battery 475. Irrespective of a state of the change switch, charge may be possible insofar as power (AC power source) is supplied to the bed 310B.

For example, when the bed apparatus 310 is driven by an AC power source, power is supplied from the control box 410 to the battery 475, an air mattress control unit 482, and a USB charger 488 (see FIG. 19). When no power is supplied from the AC power source, the battery 475 supplies power to the control box 410, the air mattress control unit 482, and the USB charger 488. When no power is supplied from the AC power source, and no power is supplied from the battery 475, the bed 310B is not operated.

As illustrated in FIG. 19, the bed apparatus 310 is provided with a sleep sensor 481, the air mattress control unit 482, and the bed user interface device 380. The bed apparatus 310 may be provided with a hand switch 483.

The sleep sensor 481 measures a sleeping status of the user (e.g., a patient) of the bed 310B. When the bed user interface device 380 is provided, a measurement result of the sleep status and a sleep history may be output to (e.g., displayed in) the bed user interface device 380.

For example, the control box 410 is provided with a connector for the air mattress control unit 482. Conjunctional operation of an air mattress may be performed in accordance with a posture of the bed 310B. The conjunctional operation may differ in accordance with a kind of the air mattress. Setting and changes of operation of the air mattress may be performed by the bed user interface device 380.

The bed apparatus 310 is further provided with auxiliary sockets 485. In this example, the two auxiliary sockets 485 are provided. The auxiliary sockets 485 are plug receptacles. The auxiliary sockets 485 include a plug 485P. The plug 485P is a plug that satisfies medical standards. The plug 485P is a 3-pin plug. The plug 485P is provided as a different component from the plug 410P of the control box 410.

The bed apparatus 310 may include the USB charger 488 (see FIG. 19). The USB charger 488 corresponds to the USB terminal 327*u* (or 347*u*). The USB charger 488 feeds power to devices that allow USB charge. The number of ports of the USB charger 488 may be 1. An output rating of the USB charger 488 is DC5V/1A. The port is disposed in the membrane switch for patients 430*c* of the right side rail.

The bed apparatus 310 may include an error display LED. The error display LED corresponds to the indicators 323*t* and 343*t*.

In the bed apparatus 310, bed departure of the user of the bed 310B may be detected. For example, the bed departure is detected by the load cells 465. For example, the bed departure is detected by load sensors incorporated in the actuators. Information concerning the bed departure is transmitted to the nurse call system and output to a terminal at the nurses' station. The information concerning the bed departure may be output to the bed user interface device 380. The output of the information concerning the bed departure may include, for example, visual stimulus such as a lamp or audio stimulus such as a warning beep.

Hereinafter, an example of the bed user interface device 380 will be described.

The bed user interface device 380 is connected to the bed 310B. With the bed user interface device 380, setting concerning the bed 310B can be performed and displayed. Languages of display in the bed user interface device 380 can be changed. For example, display in Japanese, English, Chinese or Portuguese is possible. The bed user interface device 380 is attached to, for example, the left and right side rails or the footboard 370.

The maximum number of the bed user interface devices 380 disposed on the bed apparatus 310 is, for example, 3. In one example, the single bed user interface device 380 or the single hand switch 483 (described later) is connected to the bed 310B. In another example, the single bed user interface device 380 and the single hand switch 483 are connected to the bed 310B. In another example, the two bed user interface devices 380 are connected to the bed 310B. In another example, the two bed user interface devices 380 and the single hand switch 483 are connected to the bed 310B. In another example, the three bed user interface devices 380 are connected to the bed 310B.

Figure 20:
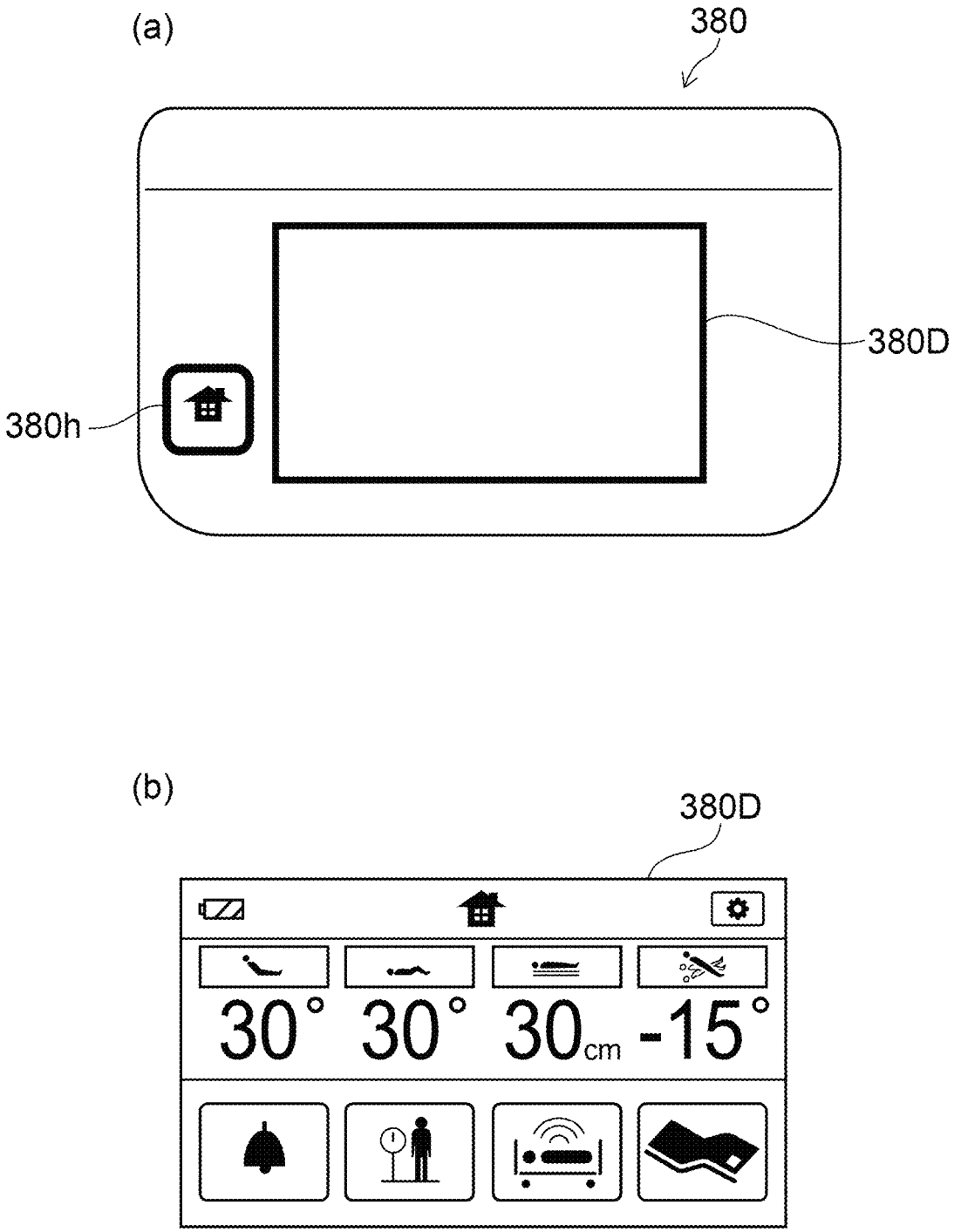
FIG. 20(*a*) and FIG. 20(*b*) are schematic diagrams illustrating part of the bed apparatus according to the embodiment.

FIG. 20(*a*) and FIG. 20(*b*) are schematic diagrams illustrating part of the bed apparatus according to the embodiment.

FIG. 20(*a*) illustrates the bed user interface device 380 mainly disposed on the head side rail (the head right side rail 320 or the head left side rail 340). The bed user interface device 380 includes a display and input portion 380D. The bed user interface device 380 is provided with a home button 380*h*.

As illustrated in FIG. 20(*b*), various kinds of display in the display and input portion 380D are possible. A posture of the bed 310B and the weight of the user can be displayed in the display and input portion 380D. With the display and input portion 380D, setting of the bed departure sensor is possible. Display concerning the sleep sensor 481 can be performed in the display and input portion 380D. With the display and input portion 380D, the air mattress can be operated. Error display can be performed by the display and input portion 380D.

Figure 21:
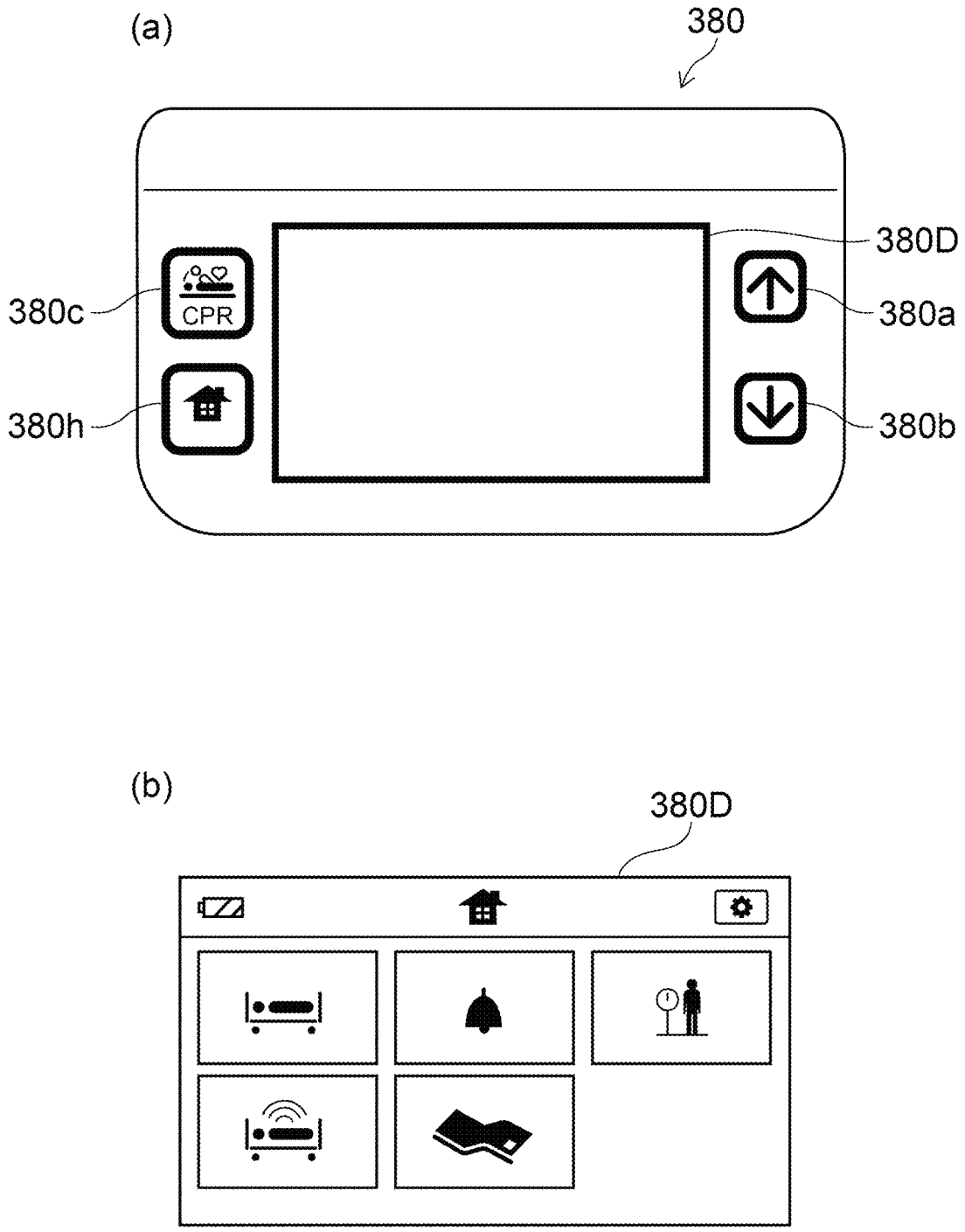
FIG. 21(*a*) and FIG. 21(*b*) are schematic diagrams illustrating part of the bed apparatus according to the embodiment.

FIG. 21(*a*) and FIG. 21(*b*) are schematic diagrams illustrating part of the bed apparatus according to the embodiment.

FIG. 21(*a*) illustrates the bed user interface device 380 mainly disposed on the footboard 370. The bed user interface device 380 includes the display and input portion 380D. In the bed user interface device 380, a raising button 380*a*, a lowering button 380*b*, and a CPR button 380*c* are provided in addition to the home button 380*h*. The raising button 380*a* or the lowering button 380*b* causes a movable part of the bed 310B to be raised or lowered. The CPR button 380*c* causes the bed 310B to shift to a posture for the CPR.

As illustrated in FIG. 21(*b*), various kinds of displays can be performed in the display and input portion 380D. The bed 310B can be operated by the display and input portion 380D. Examples of bed operation include cardiac operation, inclination operation, conjunctional operation (kind operation), back raising and lowering, knee raising and lowering, and height raising and lowering. The weight of the user can be displayed by the display and input portion 380D. Setting of the bed departure sensor can be performed by the display and input portion 380D. Display concerning the sleep sensor 481 can be performed by the display and input portion 380D. The air mattress can be operated by the display and input portion 380D. Error display can be performed by the display and input portion 380D.

Hereinafter, an example of the hand switch 483 will be described.

Figure 22:
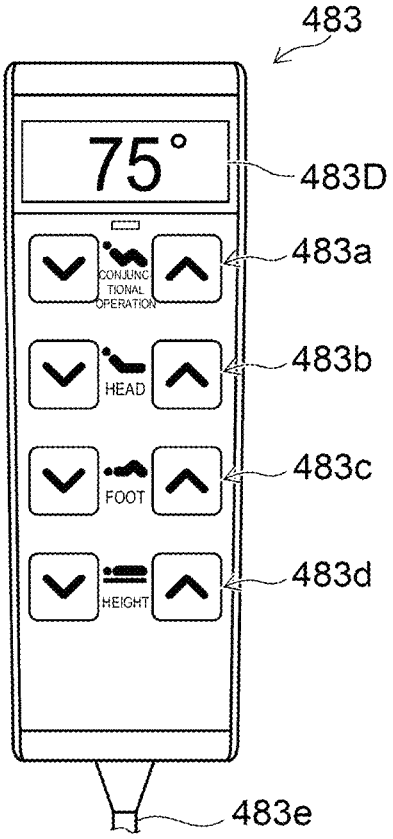
FIG. 22 is a schematic diagram illustrating part of the bed apparatus according to the embodiment.

FIG. 22 is a schematic diagram illustrating part of the bed apparatus according to the embodiment.

FIG. 22 illustrates the hand switch 483. The hand switch 483 includes switch pairs 483*a* to 483*d*. The switch pair 483*a* includes switches for raising or lowering concerning "conjunctional" operation. The switch pair 483*b* includes switches for raising or lowering concerning "back raising" operation. The switch pair 483*c* includes switches for raising or lowering concerning "foot raising" operation. The switch pair 483*d* includes switches for raising or lowering concerning "height" change operation.

An angle or a height may be displayed in a display portion 483D of the hand switch 483. The hand switch 483 is connected to the control box 410, for example, via a component such as a cable 483*e*.

Hereinafter, an example of the auxiliary socket 485 will be described.

Figure 23:
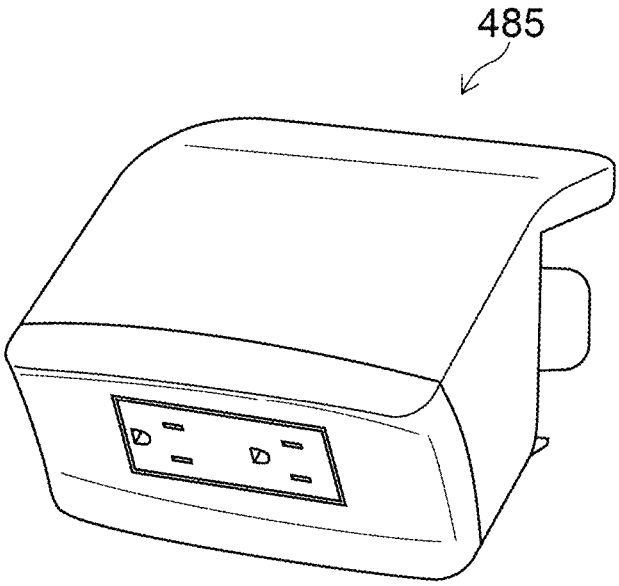
FIG. 23 is a schematic perspective view illustrating part of the bed apparatus according to the embodiment.

FIG. 23 is a schematic perspective view illustrating part of the bed apparatus according to the embodiment.

FIG. 23 illustrates the auxiliary socket 485 (e.g., plug receptacle device). A plug of an electronic appliance or the like used in the vicinity of the bed 310B can be connected to the auxiliary socket 485. As already described, the plug 485P of the auxiliary socket 485 is provided as a different component from the plug 410P of the control box 410. The auxiliary socket 485 includes two sets of plug receptacles (plug insertion holes). The two sets of plug receptacles are disposed side by side.

Figure 24:
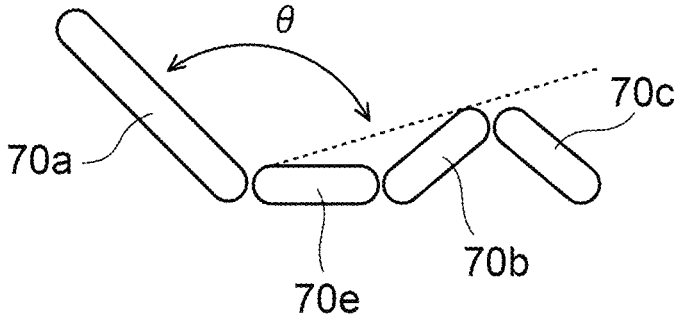
FIG. 24 is a schematic diagram illustrating part of the bed apparatus according to the embodiment.

FIG. 24 is a schematic diagram illustrating part of the bed apparatus according to the embodiment.

FIG. 24 illustrates the back section 70*a*, the upper leg section 70*b*, the lower leg section 70*c*, and the seat section 70*e*. An angle of each of the back section 70*a*, the upper leg section 70*b*, and the lower leg section 70*c* is variable. Angles between the sections are controlled not to be equal to or less than a predetermined value (e.g., 90 degrees). For example, an angle between a line connecting a lower end of the back section 70*a* and an upper end of the upper leg section 70*b* (a dashed line in FIG. 24), and the back section 70*a* is controlled to be equal to or less than the predetermined value (e.g., 90 degrees). For example, control (conjunctional operation) of movements of some of the plurality of sections causes the angles to be equal to or less than the predetermined value.

An operation angle of the back section 70*a* is, for example, 0 degree to 70 degrees. An operation angle of the upper leg section 70*b* is, for example, equal to or larger than 0 degree and equal to or less than 25 degrees. An operation range of the "height" is, for example, 43 cm. The bed height may be different in accordance with the bed frame. A range of the bed height is, for example, 30 cm to 73 cm, 32.5 cm to 75.5 cm, or 35 cm to 78 cm.

An operation angle of inclination of the sections is −15 degrees to 15 degrees. For example, to avoid interference in the bed frame, an inclination operation is performed after the height is adjusted to a "minimum bed height+3 cm".

Operation of the bed 310B to shift to the cardiac position and operation of the bed 310B to make the sections flat are accompanied with the inclination operation. An operation sequence considering slippage of the user is applied to these operations.

In the electric CPR operation, operations are performed in the following sequence. At the time, when simultaneous operations are possible, operations may be performed simultaneously. In the electric CPR operation, the actuator 470*c* ("back ACT") for the back section 70*a* is first operated to a lower limit of its stroke. Within 30 seconds after a button for the electric CPR operation is depressed, the actuator 470*c* reaches the lower limit. Thereafter, inclination operation is performed to make an inclination angle 0 degree. Thereafter, height adjustment is performed to make the height the minimum bed height. The minimum bed height is, for example, a "temporary pause height". Thereafter, the upper leg section 70*b* is operated to be at 0 degree.

In the bed apparatus 310, operation of the bed user interface device 380 can cause button operations relating to various kinds of operation to be in an "operation inhibited" state.

Figure 25:
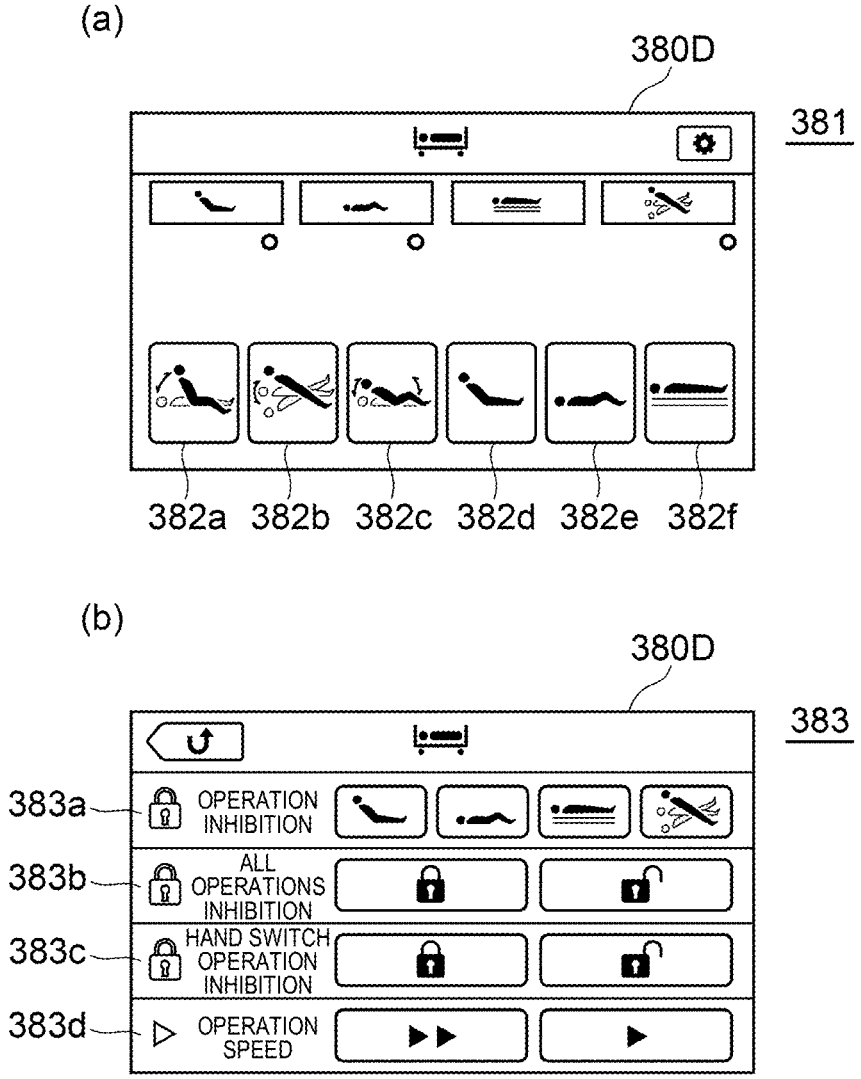
FIG. 25(*a*) and FIG. 25(*b*) are schematic diagrams illustrating part of the bed apparatus according to the embodiment.

FIG. 25(*a*) and FIG. 25(*b*) are schematic diagrams illustrating part of the bed apparatus according to the embodiment.

These drawings illustrate the display and input portion 380D of the bed user interface device 380. FIG. 25(*a*) illustrates a case where the display and input portion 380D is a bed user interface display screen 381. FIG. 25(*b*) illustrates a case where the display and input portion 380D is an actuator individual operation inhibition display screen 383 (a bed setting display screen).

As illustrated in FIG. 25(*a*), for example, buttons 382*a* to 382*f* are provided. These buttons are, for example, a user interface input region in a touch input device. These buttons are touched to perform bed operation. Cardiac operation is performed by the button 382*a*. Inclination operation is performed by the button 382*b*. Conjunctional operation ("kind operation") is performed by the button 382*c*. Back operation (back angle change) is performed by the button 382*d*. Knee operation (knee angle change) is performed by the button 382*e*. Height operation (height change) is performed by the button 382*f*. For example, in the case of raising the back of the bed 310B, the button 382*d* is depressed, and thereafter, the raising button 380*a* so as to move the bed 310B. The bed 310B is moved while the raising button 380*a* is being depressed. For example, in the case of lowering the height of the bed, the button 382*f* is depressed, and thereafter, the lowering button 380*b* so that the height of the bed 310B is lowered while the lowering button 380*b* is being depressed.

As illustrated in FIG. 25(*b*), the display and input portion 380D can shift to the actuator individual operation inhibition display screen 383 (the bed setting display screen). When a display and input region 383*a* is operated, each of the back operation, the knee operation, the height operation, and the inclination operation can be individually inhibited. When a display and input region 383*b* is operated, all the operations can be inhibited, or operation inhibition can be released. When a display and input region 383*c* is operated, operation of the hand switch 483 can be inhibited or operation inhibition can be released.

For example, when the back operation is inhibited, the cardiac operation, the conjunctional operation, and the back operation are inhibited. For example, when the knee operation is inhibited, the cardiac operation, the conjunctional operation, and the knee operation are inhibited. For example, when the height operation is inhibited, the cardiac operation, the inclination operation, and the height operation are inhibited. For example, when the inclination operation is inhibited, the cardiac operation and the inclination operation are inhibited.

In one example, "all operations inhibition" is possible. In another example, "operation inhibition" of the actuators 470 (e.g., 470*a* to 470*d* (see FIG. 19)) may be selectively (individually) performed. The "operation inhibition" of the actuators 470 is released by the bed user interface device 380.

When the bed user interface device 380 is detached from the bed 310B or when a cable to connect the bed user interface device 380 breaks, for example, the selective "operation inhibition" of the actuators 470 cannot be released. In this case, the "operation inhibition" of the actuators 470 can be released by releasing the "all operations inhibition".

The operation inhibition of the actuators 470, the operation inhibition of the hand switch 483 or the "all operations inhibition" is independently controlled. For example, in the case of individual operation inhibition of the actuators 470, the "all operations inhibition" is performed. Thereafter, even when the "all operations inhibition" is released, the individual operation inhibition of the actuators 470 remains.

When an inhibited button is depressed, a buzzer sounds, and an inhibition LED (e.g., indicators 323*t* and 343*t*) of the membrane switch flashes on and off. When no buzzer sounds, it is not clear whether the button is inhibited or broken. When a buzzer sounds, it can be made clear that the button is inhibited.

When an inhibited button in the hand switch 483 is depressed, the hand switch 483 rumbles. An inhibited button in the membrane switch is depressed, the junction box 420, for example, rumbles.

Operation of the membrane switch for medical workers or the bed user interface device 380 can make the membrane switch for patients and the hand switch 483 shift to an operation inhibited state. The operation inhibition can be released insofar as the membrane switch for medical workers or the bed user interface device 380 is connected.

Operation of the membrane switch for medical workers or the bed user interface device 380 makes it possible to inhibit all operations ("all operations inhibition"). This operation inhibition can be released insofar as one of the membrane switch for medical workers and a bed navigator is connected.

For example, when the bed user interface device 380 is not connected to the bed 310B or has partial malfunction (establishes no communication), the "all operations inhibition" is released. In this case, for example, the operation can be performed by the hand switch 483. When the user is hindered from operation, the hand switch 483 may be detached. When an inhibited button is depressed, a buzzer sounds, and the inhibition LED of the membrane switch flashes on and off.

When the "all operations inhibition" button is depressed in an operation inhibited state of the hand switch 483, the "all operations inhibition" is established. Thereafter, when the "all operations inhibition" is depressed, the operation inhibition of the hand switch 483 and the all operations inhibition are released. During the "all operations inhibition", the CPR operation is performed. In any of the "operation inhibition", the "hand switch operation inhibition", and the "all operations inhibition", the CPR operation is performed.

For example, in a "present setting", in the case where the hand switch 483 is not set in operation inhibition, and the "all operations inhibition" is not set, and when the operation inhibition button in the hand switch 483 is depressed, the hand switch 483 shifts to operation inhibition, and "all the operations" are not inhibited (a released state).

For example, in a "present setting", in the case where the hand switch 483 is not in operation inhibition, and the "all operations inhibition" is not set, and when the "all operations inhibition" button is depressed, the hand switch 483 and all the operations are inhibited.

For example, in a "present setting", in the case where the hand switch 483 is in operation inhibition, and the "all operations inhibition" is not set, and when the operation inhibition button in the hand switch 483 is depressed, the hand switch 483 is not in operation inhibition (a released state), and "all the operations" are not in operation inhibition (a released state).

For example, in a "present setting", in the case where the hand switch 483 is in operation inhibition, and the "all operations inhibition" is not set, and when the "all operations inhibition" button is depressed, the hand switch 483 and all the operations are inhibited.

For example, in a "present setting", in the case where the hand switch 483 is in operation inhibition, and the "all operations inhibition" is set, and when the operation inhibition button in the hand switch 483 is depressed, the hand switch 483 and all the operations are inhibited.

For example, in a "present setting", in the case where the hand switch 483 is in operation inhibition, and the "all operations inhibition" is set, and when the "all operations inhibition" button is depressed, the hand switch 483 is not in operation inhibition (a released state), and all the operations are not inhibited (a released state).

Operation of the display and input region 383*d* illustrated in FIG. 25(*b*) makes it possible to change an operation speed. For example, speeds of various kinds of operation can be changed into a plurality of stages (e.g., 2 stages).

A history relating to various kinds of operation of the bed apparatus 310 may be preserved. The history is preserved in a memory in the control box 410, for example. The memory where the history is preserved may be provided in the junction box 420 or the hand switch 483, for example. The memory where the history is preserved may be provided in the bed user interface device 380. Information concerning the history is not reset by turning on or off the power source. The information concerning the history includes, for example, an operation history of the control box 410, an operation history of the actuators 470, an operation history of the hand switch 483, a history of operation details, a malfunction history, and a bed departure and presence history.

The embodiment may include the following configurations.

(Configuration 1)

A structure configured to be detachably attached to a bed apparatus including a holder and a first frame that includes a portion extending in a first direction, the structure including:

a first portion of a columnar shape extending in a second direction that intersects the first direction; and a second portion continuous to the first portion and including a portion extending in a third direction that intersects the second direction, wherein the first portion is inserted in the holder so that the holder is configured to hold the structure, and wherein when the structure is attached to the bed apparatus, an angle between the first direction and the third direction is variable.

(Configuration 2)

The structure according to configuration 1, further including a lower leg section, wherein when the structure is attached to the bed apparatus, the holder is below the lower leg section.

(Configuration 3)

The structure according to configuration 1 or 2, wherein the bed apparatus includes a length direction and a width direction, and a length of the bed apparatus in the length direction is larger than a length of the bed apparatus in the width direction, and wherein when the structure is attached to the bed apparatus, a position of the holder in the width direction is outside of the lower leg section in the width direction.

(Configuration 4)

The structure according to any one of configurations 1 to 3, wherein the first frame includes an extension extending in the first direction, and wherein when the structure is attached to the bed apparatus, the holder is secured to the extension.

(Configuration 5)

The structure according to any one of configurations 1 to 4, wherein the second portion includes a grip.

(Configuration 6)

The structure according to any one of configurations 1 to 5, wherein the structure includes a hole formed in a lower portion of the second portion.

According to the embodiment, it is possible to provide the structure and the bed apparatus that can facilitate aid of bed departure.

Heretofore, with reference to specific examples, the embodiment of the invention has been described. However, the invention is not to be limited to these specific examples. Specific configurations of elements, such as the frame, the side rails, the structure, and the base frame, fall within the scope of the invention insofar as the specific configurations are appropriately selected from a known scope by those skilled in the art so that the invention can be likewise implemented, and that substantially the same effects can be acquired.

Moreover, when any two or more elements in each of the specific examples are combined in a technically possible range, the combination also falls within the scope of the invention insofar as the combination encompasses the subject matter of the invention.

In addition, all bed apparatuses that those skilled in the art can implement by appropriate design change based on the bed apparatuses described above as the embodiment of the invention belong to the scope of the invention insofar as the bed apparatuses encompass the subject matter of the invention.

Furthermore, within the soul and spirit of the invention, those skilled in the art can easily conceive various modifications and alterations, and it is to be understood that these modifications and alterations also belong to the scope of the invention.

DESCRIPTION OF REFERENCE NUMERALS AND SIGNS

61 . . . first side rail, 61*a* to 61*c* . . . first recess to third recess, 62 . . . second side rail, 62*u* . . . upper end, 65 . . . structure, 65A . . . first portion, 65Ah . . . hole, 65B . . . second portion, 65BH . . . grip, 65Bh . . . hole, 65Bu . . . upper end, 65*a*, 65*b* . . . first groove, second groove, 65*e* . . . lower end, 68 . . . bed controller, 70*a* . . . back section, 70*b* . . . upper leg section, 70*c* . . . lower leg section, 71 . . . first frame, 71*b* . . . cross bar, 71*e* . . . extension, 71*h* . . . holder, 71*r* . . . frame body, 72 . . . second frame, 73 . . . third frame, 75B . . . base frame, 77*p* . . . plunger, 77*q* . . . knob bolt, 78A . . . headboard, 78B . . . footboard, 78Bu . . . upper end, 78M . . . mattress, 110 . . . bed apparatus, D1 to D3 . . . first direction to third direction, Dh . . . length direction, Dw . . . width direction, ST1 to ST4 . . . first state to fourth state, 310 . . . bed apparatus, 310B . . . bed, 320 . . . head right side rail, 320F . . . outer surface, 320G . . . inner surface, 323 . . . switch portion, 323*a* to 323*q* . . . switch, 323*r* to 323*t* . . . indicator, 324 . . . angle meter, 324*a* . . . display, 325*a* . . . protrusion, 325*b* . . . recess, 325*c* . . . head-side protrusion, 325*d* . . . head-side recess, 325*e* . . . through hole, 325*f* . . . lower through hole, 325*g* . . . handrail, 325*h* . . . through hole, 327 . . . switch portion, 327*a* to 327*d* . . . switch, 327*n* . . . switch, 327*u* . . . USB terminal, 328 . . . recess, 328*h* . . . hole, 330 . . . foot right side rail, 330F . . . outer surface, 330G . . . inner surface, 334 . . . angle meter, 334*a* . . . display, 335*f* . . . lower through hole, 335*g* . . . handrail, 335*h* . . . through hole, 340 . . . head left side rail, 340F . . . outer surface, 340G . . . inner surface, 343 . . . switch portion, 343*a* to 343*q* . . . switch, 343*r* to 343*t* . . . indicator, 344 . . . angle meter, 344*a* . . . display, 345*e* . . . through hole, 347 . . . switch portion, 347*a* to 347*d* . . . switch, 347*n* . . . switch, 347*u* . . . terminal, 350 . . . foot left side rail, 350F . . . outer surface, 350G . . . inner surface, 354 . . . angle meter, 354*a* . . . display, 355*g* . . . handrail, 360 . . . headboard, 370 . . . footboard, 370F . . . outer surface, 370G . . . inner surface, 375*e* . . . through hole, 380 . . . bed user interface device, 380D . . . display and input portion, 380*a* . . . raising button, 380*b* . . . lowering button, 380*c* . . . CPR button, 380*h* . . . home button, 381 . . . bed user interface display screen, 382*a* to 382*f* . . . button, 383 . . . actuator individual operation inhibition display screen, 383*a* to 383*d* . . . display and input region, 390B . . . base frame, 390C . . . caster, 390F . . . frame, 390M . . . mattress, 398 . . . care worker or the like, 410 . . . control box, 410P . . . plug, 420 . . . junction box, 430 . . . membrane switch, 430*a*, 430*b* . . . membrane switch for medical workers, 430*c*, 430*d* . . . membrane switch for patients, 431*a*, 431*b* . . . relay unit, 440 . . . foot lamp, 450 . . . side rail sensor, 455 . . . caster lock sensor, 457*a*, 457*b* . . . nurse call link, 458 . . . nurse call relay unit, 460 . . . scale unit, 465 . . . load cell, 470 . . . actuator, 470*a* to 470*d* . . . actuator, 475 . . . battery, 481 . . . sleep sensor, 482 . . . air mattress control unit, 483 . . . hand switch, 483D . . . display, 483*a* to 483*d* . . . switch pair, 483*e* . . . cable, 485 . . . auxiliary socket, 485P . . . plug, 488 . . . charger

The invention claimed is:

1. A structure configured to be detachably attached to a bed apparatus comprising a first frame with a portion extending in a first direction and a holder, the structure comprising:

a first portion of a columnar shape, the first portion configured to be inserted into the holder and held by the holder, the first portion extending in a second direction that intersects the first direction when inserted in the holder; and a second portion connected to the first portion at a first end of the first portion and comprising a portion extending in a third direction that intersects the second direction when the first portion is in the holder, wherein when the first portion is in the holder, an angle between the portion of the first frame and the second portion of the structure can be change by movement of the structure, a second end of the first portion of the structure includes a first groove and a second groove intersecting the first groove, and the first and second grooves are each facing outwardly from the second end of the first portion and configured to engage a crossbar piece of the holder such that the first groove engages the crossbar piece when the angle between the portion of the first frame and the second portion of the structure is a first angle and the second groove engages the crossbar piece when the angle between the portion of the first frame and the second portion of the structure is a second angle, different from the first angle.

2. The structure according to claim 1, wherein the second portion comprises a grip.

3. The structure according to claim 1, wherein a hole is formed in a lower portion of the second portion of the structure.

4. The structure according to claim 1, wherein the first and second grooves intersect one another at substantially 90°.

5. The structure according to claim 1, wherein the first portion of the structure includes a recess proximate to the first end, and the recess is configured to receive a plunger element of the holder when the first portion is inserted into the holder.

6. The structure according to claim 1, wherein the first portion of the structure includes a hole proximate to the first end, and the hole is configured to receive a plunger element of the holder when the first portion is inserted into the holder.

7. A bed apparatus, comprising:

a first frame with a portion extending in a first direction;

a holder attached to the first frame; and a structure according to claim 1 inserted in the holder.

8. The bed apparatus according to claim 7, further comprising:

a lower leg section, wherein the holder is below the lower leg section.

9. The bed apparatus according to claim 8, wherein a length of the bed apparatus is greater than a width of the bed apparatus, and the holder is positioned outside the lower section in the width direction.

10. The bed apparatus according to claim 7, wherein the first frame comprises an extension extending in the first direction, and the holder is secured to the extension of the first frame.

* * * * *